United States Patent [19]

Chino et al.

[11] Patent Number: 4,962,016

[45] Date of Patent: Oct. 9, 1990

[54] SILVER HALIDE PHOTOGRAPHIC LIGHT-SENSITIVE MATERIAL

[75] Inventors: Shigeo Chino, Tokyo; Mitsuhiro Okumura, Sagamihara, both of Japan

[73] Assignee: Konica Corporation, Tokyo, Japan

[21] Appl. No.: 299,591

[22] Filed: Jan. 23, 1989

[30] Foreign Application Priority Data

Jan. 30, 1988 [JP] Japan ..... 63-20372

[51] Int. Cl.[5] ..... G03C 1/06; G03C 1/30

[52] U.S. Cl. ..... 430/603; 430/608; 430/611; 430/622; 430/623; 430/628; 430/629

[58] Field of Search ..... 430/551, 603, 608, 622, 430/623, 628, 611, 629

[56] References Cited

U.S. PATENT DOCUMENTS 3,189,458 6/1965 Herz ..... 430/600

4,661,441 4/1987 Kajiwara et al. ..... 430/555

FOREIGN PATENT DOCUMENTS 0243202 10/1987 European Pat. Off. ..... 430/626

*Primary Examiner*—Paul R. Michl
*Assistant Examiner*—Janet C. Baxter
*Attorney, Agent, or Firm*—Finnegan, Henderson, Farabow, Garrett & Dunner

[57] ABSTRACT

A silver halide photographic light-sensitive material which has an excellent gradation and an excellent pressure resistance. The photographic material comprising a support and, provided thereon, a photographic component layer including a silver halide emulsion layer in which the sewlling degree of said photographic component layer is not higher than 150 and said silver halide emulsion layer is added with elementary sulfur.

13 Claims, No Drawings

SILVER HALIDE PHOTOGRAPHIC LIGHT-SENSITIVE MATERIAL

FIELD OF THE INVENTION

This invention relates to a silver halide photographic light-sensitive material, hereinafter referred to as a light-sensitive material, and, more particularly, to a light-sensitive material which is high in sensitivity and excellent in both gradiation and pressure resistance.

BACKGROUND OF THE INVENTION

In recent years, there has been demand in the field of the art for a light-sensitive material which is capable of being rapidly processable, high in image quality, excellent in processing stability and inexpensive in cost and, in particular, for a light-sensitive material capable of being rapidly processable.

To be more concrete, an automatic processor is installed at a photofinishing laboratory to process light-sensitive materials. One of the services given to customers is the return of finished films and prints to customers on the same day the photofinishing orders are received and, quite recently, to return them within several hours after receiving the finishing orders, therefore the developments of more rapidly processable light-sensitive materials have been urgently required.

On the other hand, there have been increased instances where light-sensitive materials are liable to mechanical pressure when they are treated in equipments such as printers and automatic processors. When a light-sensitive material is applied with various pressures as mentioned above, the silver halide grains of the light-sensitive material are also applied with a pressure through the binders. i.e., gelatin. of the silver halide grains. When the silver halide grains are applied with a pressure, the photographic characteristics of the light-sensitive material are also varied in such a phenomenon as pressure desensitization, pressure fog or the like. Particularly in the case of a rapid processing, the light-sensitive material is liable to a stronger pressure because it is transported faster. This phenomenon has been far well-known as a photographic pressure effect and is described in, for example, T. H. James, 'The Theory of Photographic Process' 4th Ed., Macmillan Publishing Co., New York, Paragraph 24; ; D. Dautrich, F. Granzer and E. Moisar, 'Journal of Photographic Science', 21, p. 221, 1973; and so forth.

Light-sensitive materials are applied with a pressure in two cases. i.e., in dried conditions and in wet conditions in which a developing process is being carried out. It cannot, therefore, be said that an effect can be satisfactorily displayed unless the pressure resistance can be improved in both of the conditions, respectively.

Accordingly, there have been attempts to provide light-sensitive materials having more stability against pressure. For example, they are disclosed in Japanese Patent Publication Open to Public Inspection (hereinafter referred to as Japanese Patent O.P.I. Publication) No. 53-13923/1978, a high boiling solvent is contained in an amount of not less than 20% by weight of the binders thereof in a coupler-containing layer; in Japanese Patent Publication No. 57-12133/1982, a coupler and a conversion emulsion are used: in British Patent No. 738,618, a heterocyclic compound is used: in U.S. Pat. No. 2,960,404, a polyhydric alcohol is used; and so forth. However, no satisfactory effect can be obtained from the above-disclosed techniques.

Further, Japanese Patent O.P.I. Publication No. 62-250437/1987 discloses a method that a light-sensitive material, which is comprised of a silver halide mainly composed of silver chloride and a water-soluble iridium compound, is hardened with a specific layer hardener. It was, however, found that such a light-sensitive material is still not satisfactory, some effects may be obtained on pressure resistance in wet conditions though, but is still not improved in the pressure resistance in dry conditions and is too low in sensitivity and too soft in contrast to be applied suitably to a rapid processing.

SUMMARY OF THE INVENTION

It is an object of the invention to solve the above-mentioned problems of the prior art so as to provide a silver halide photographic light-sensitive material having a high sensitivity, an excellent gradiation and an excellent pressure resistance.

This invention can be achieved with a silver halide photographic light-sensitive material comprising a support bearing thereon a photographic component layer including a silver halide emulsion layer, wherein the swelling degree of the photographic component layer is not higher than 150 and the silver halide emulsion layer is added with elementary sulfur.

DETAILED DESCRIPTION OF THE INVENTION

In this invention, a swelling degree shall be defined the following formula, $$\text{Swelling degree} = \left( \frac{\text{Layer thickness of swelled sample } (\mu m)}{\text{Layer thickness of untreated sample } (\mu m)} - 1 \right) \times 100$$

provided that a sample light-sensitive material is dipped in the following color developer being kept at 35° C. for 45 seconds and the thickness (μm) thereof is measured after it was swelled and, on the other hand, another and the same sample is left untreaded and the thickness (μm) thereof is measured.

| COLOR DEVELOPER | |
|---|---|
| Pure water | 800 ml |
| Triethanolamine | 12 ml |
| N,N-diethylhydroxylamine in a 85% aqueous solution | 12 ml |
| Potassium chloride | 2.2 g |
| Potassium sulfite | 0.2 g |
| N-ethyl-N-β-methanesulfonamidoethyl-3-ethyl-4-aminoaniline sulfate | 5.0 g |
| 1-hydroxyethylidene-1,1-diphosphonic acid | 1.0 g |
| Ethylenediamine tetraacetic acid | 2.0 g |
| Water-soluble optical brightening agent of diaminostilbene type | 2.0 g |
| Add water to make | 1 liter |
| Adjust pH to | pH 10.1 |

Swelling degree should be, preferably, not higher than 150, preferably, not lower than 80 but not higher than 150 and, further preferably, not lower than 100 but not higher than 140. When a swelling degree is lower than 80, it is not desirable, because a development rate is lowered and a sensitivity is somewhat lowered. When it is higher than 150, it is not desirable, because a pressure resistance is seriously deteriorated. In this case, in particular, a blue-sensitive emulsion layer having a relatively larger grain size is deteriorated conspicuously.

In order to make a swelling degree to be not higher than 150 in this invention, it is desirable to harden a light-sensitive material with a vinylsulfone type hardener or the compounds represented by the following formulas I or II.

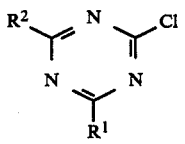

Formula I wherein $R^1$ represents a chlorine atom or a group of hydroxy, alkyl, alkoxy, alkylthio, —$OM_1$ in which $M_1$ is a univalent metal atom, —$NR^5R^6$ in which $R^5$ and $R^6$ each are a hydrogen atom or a group of alkyl or aryl, or —$NHCOR^7$ in which $R^7$ is a hydrogen atom or a group of alkyl or aryl; and $R^2$ is synonymous with the above $R^1$ except a chlorine atom.

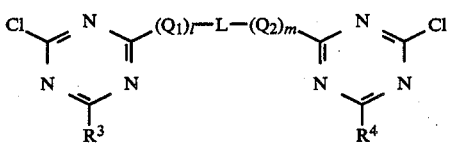

Formula II wherein $R^3$ and $R^4$ each represent a chlorine atom or a group of hydroxy, alkyl, alkoxy or —$OM_1$ in which $M_1$ is a univalent metal atom; $Q_1$ and $Q_2$ each represent a linkage group selected from the group consisting of —O—, —S— and —NH—; L represents a group of alkylene or arylene; l and m each are an integer of 0 to 1.

The vinylsulfone type hardeners applicable to this invention include, for example, the aromatic compounds such as those described in West German Patent No. 1, 100,942; the alkyl compounds each bonded to a hetero atom such as those described in Japanese Patent Examined Publication Nos. 44-29622/1969 and 47-25373/1972; the sulfonamido ester compounds such as those described in Japanese Patent Examined Publication No. 47-8736/1972; 1,3,5-tris[β-(vinylsulfonyl)-propionyl]-hexahydro-s-triazine such as described in Japanese Patent O.P.I. Publication No. 49-24435/1974; or the alkyl type compounds such as those described in Japanese Patent O.P.I. Publication No. 51-44164/1976.

The typical compounds thereof will be given below, to which, however, the invention shall not be limited.

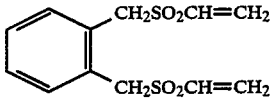

H-1

$O(CH_2CH_2SO_2CH{=}CH)_2$ H-2

$NH(CH_2CH_2SO_2CH{=}CH_2)_2$ H-3

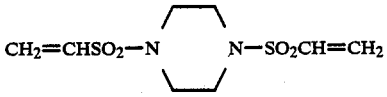

H-4

-continued

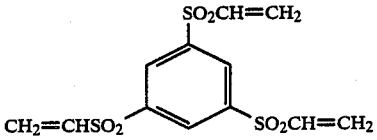

H-5

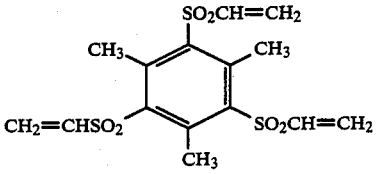

H-6

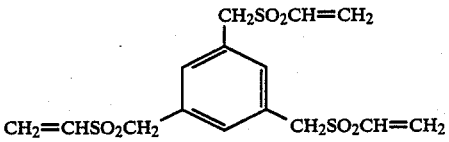

H-7

$CH_3C(CH_2OCH_2SO_2CH{=}CH_2)_3$ H-8

$C(CH_2OCH_2SO_2CH{=}CH_2)_4$ H-9

$N(CH_2CH_2OCH_2SO_2CH{=}CH_2)_3$ H-10

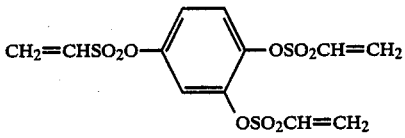

H-11

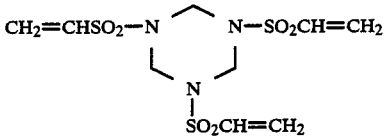

H-12

$C_2H_5C(CH_2SO_2CH{=}CH_2)_3$ H-13

$C_8H_{17}C(CH_2SO_2CH{=}CH_2)_3$ H-14

$CH_2{=}CHSO_2CH_2CHCH_2SO_2CH{=}CH_2$ H-15
$\quad\quad\quad

-continued

H-22

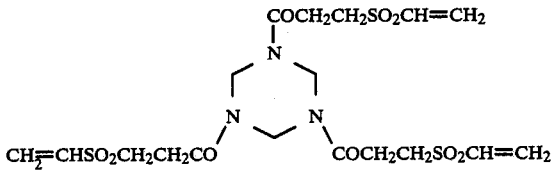

Besides the above-given exemplified compounds, the vinylsulfone type harders applicable to this invention also include the reaction products each obtained by reacting a compound having at least three vinylsulfone groups in the molecular structure thereof such as Exemplified Compounds H-5 through H-22 with such a compound as diethanolamine. thioglycolic acid, sarcosine sodium salt and taurine sodium salt each having both of a water-soluble group and a group capable of reacting with a vinylsulfone group.

Next, the compounds relating to this invention each represented by the foregoing Formulas I and II will now be detailed.

In Formulas I and II, the alkyl, alkoxy and alkylthio groups each represented by $R^1$ include the alkyl groups each having 1 to 3 carbon atoms, such as a group of methyl, ethyl, methoxy, ethoxy, methylthio, ethylthio or the like.

In the —$OM_1$ group represented by $R^1$, $M_1$ representing a univalent metal atom include, for example, sodium, potassium. ammonium and so forth. The alkyl groups represented by $R^5$ and $R^6$ of the —$NR^5R^6$ group include, for example, the alkyl groups each having 1 to 3 carbon atoms, such as a group of methyl, ethyl or the like. The aryl groups include, for example, a phenyl group.

The alkyl and aryl groups each represented by $R^7$ of the —$NHCOR^7$ groups represented by $R^1$ are the synonymous with the alkyl and aryl groups represented by the foregoing $R^5$ and $R^6$.

The groups represented by $R^2$ are synonymous with the groups represented by the foregoing $R^1$ except the foregoing chlorine atom.

Next, the groups represented by $R^3$ and $R^4$ are synonymous with the groups represented by the foregoing $R^1$.

The alkylene groups represented by L include, for example, those each having 1 to 3 carbon atoms, such as a group of methylene, ethylene or the like. The arylene groups include, for example, a phenylene group.

Next, some typical examples of the hardeners relating to this invention each represented by the foregoing Formulas I and II will now be given below.

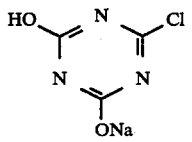

(I-1)

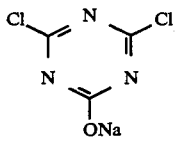

(I-2)

-continued

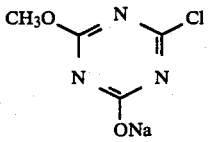

(I-3)

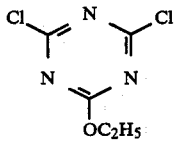

(I-4)

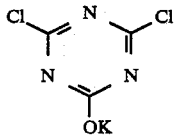

(I-5)

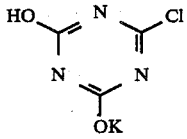

(I-6)

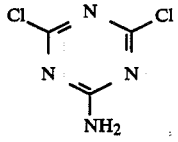

(I-7)

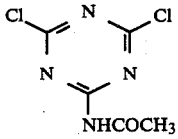

(I-8)

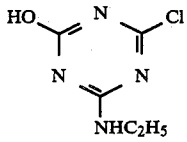

(I-9)

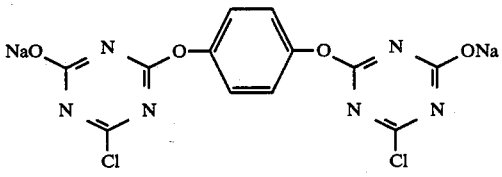

(II-1)

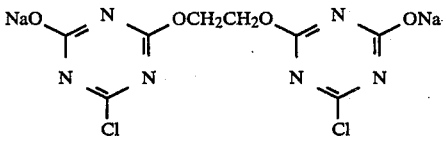

(II-2)

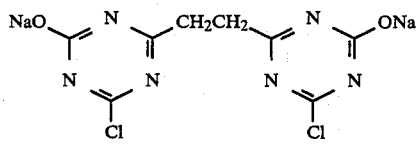

(II-3)

-continued

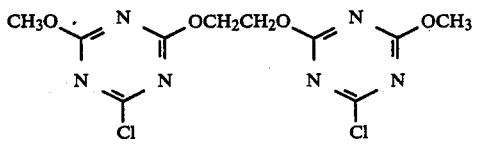

(II-4)

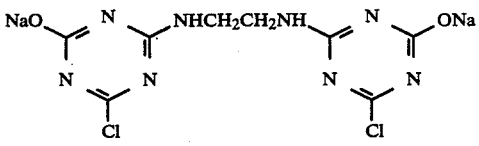

(II-5)

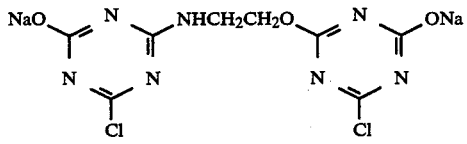

(II-6)

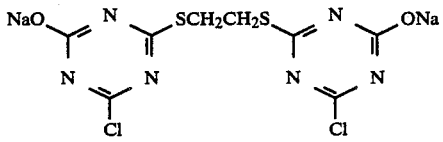

(II-7)

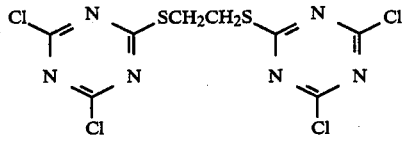

(II-8)

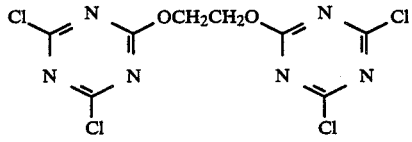

(II-9)

The foregoing vinylsulfone type hardeners and the hardeners represented by Formulas I and II, each relating to this invention, may be added into a silver halide emulsion layer or the other component layers in such a manner that they are dissolved in water or a water-miscible solvent such as methanol, ethanol or the like and the resulting solution may be added into the coating solution of the above-mentioned component layers. The methods of adding them may be either a batch method or an in-line method. The point of time when adding them shall not be limitative, but it should be preferred to add them immediately before coating a component layer.

The foregoing vinylsulfone type hardeners relating to the invention and the hardeners represented by Formulas I and II may be used either independently or in combination. It is particularly preferable to use either the vinylsulfone type hardener and those represented by Formula I in combination or the vinylsulfone type hardener and those represented by Formula II in combination. These hardeners may be added into either the same layer or the different layers. It is more preferable to add them into the different layers.

These hardeners are to be added in an amount of from 0.5 to 100 mg per g of gelatin coated and, more preferably, from 5.0 to 50 mg.

The hardener relating to the invention and the amount thereof added are selected, respectively, so that the swelling degree may be as specified by the invention, when coating and drying the hardener relating to the invention and then allowing the hardener to stand for a period of from 15 to 180 hours under the conditions of a temperature of from 30° to 55° C./ and a relative humidity of from 30 to 80%.

It is not preferable to make a swelling degree be not higher than 150 under the other conditions than the above-specified conditions, because the effects of pressure resistance cannot satisfactorily be obtained.

The term 'elementary sulfur' used in this invention, means the so-called single substance of sulfur which is not a form of compound with any other elements.

In the invention, therefore, the 'elementary sulfur' does not include any sulfur-containing compounds which are known as the photographic additives in the art, such as a sulfide, sulfuric acid and the salts thereof, sulfurous acid and the salts thereof, thiosulfuric acid and the salts thereof, sulfonic acid and the salts thereof, a thioether compound, a thiourea compound, a mercapto compound, a sulfur-containing hererocyclic compound, and so forth.

It has been known that the 'elementary sulfur' of single substance applicable to the invention has several allotropes. Any of such allotropes may also be used.

Among the above-mentioned allotropes, those stable at room temperature include α-sulfur which belongs to rhombic system. It is preferable in the invention to use such α-sulfur.

When adding such 'elementary sulfur' relating to the invention, it is allowed to add it in the form of a solid matter, but it is preferable to add it in the form of a solution. It has been known that such elementary sulfur is not soluble to water but to carbon disulfide, sulfur chloride, benzene, diethylether, ethanol and so forth. It is preferable to add it upon dissolving it in one of the above-given solvents. Among these solvents for the elementary sulfur, ethanol is particularly preferable from the view- points of easy handling, photographic influence and so forth.

Such elementary sulfur may be added in a suitable amount according to the kinds of silver halide emulsion layers, what is expected as the effects, and so forth. However, it is to be added an amount within the range of from $1\times10^{-5}$ mg to 10 mg per mol of silver halides used and, more preferably, from $1\times10^{-3}$ mg to ≡mg.

Such elementary sulfur may be added in the steps of manufacturing a silver halide photographic light-sensitive material, such as any step selected from the steps consisting of a silver halide grain forming step, a chemical sensitizing step that is, in other words, a chemical ripening step, a coating solution preparing step, and a coating and drying step. To be more concrete, in the case of adding elementary sulfur in the silver halide grain forming step, it may be added before the nuclei of silver halide crystals are produced, to grow silver halide crystals in the presence of elementary sulfur, or when the nuclei of the silver halide grains are completely grown. It may also be added before or after removing excessive salts upon completion of crystal growth.

In the case of adding elementary sulfur into the chemical sensitizing step, it may be added at any point of time selected from the points of time including the point of time when starting a chemical sensitization that is when adding a chemical sensitizer, a point of time during the chemical sensitization and the point of time when completing the chemical sensitization that is when adding the chemical sensitization stopping agent.

In the case of adding elementary sulfur into the coating solution preparing step, it may be added at any points of time in the course that a coating solution is prepared by mixing a silver halide emulsion and a coupler dispersion together with, if required, a variety of additives such as an aqueous gelatin solution, a surfactant, a thickener, a layer hardener, a dyestuff, a development inhibitor and so forth and, in other words, at any point of time in the course from the point of time when completing the chemical sensitization to the point of time when the coating solution is coated on.

Among the above-mentioned steps, it is particularly preferable to add elementary sulfur either in the initial stage of a chemical sensitization so as to carry out the chemical and/or spectral sensitizations in the presence of the elementary sulfur, or at the point of time when completing the chemical sensitization.

In the case of adding elementary sulfur in the chemical sensitizing step, that is, at a preferable adding point of time, not only the sensitivity variation effect against humidity becomes relatively more excellent but also a fog production is diminished.

In the case of adding elementary sulfur in the initial stage of a chemical sensitizing step so as to carry out the chemical sensitization in the presence of the elementary sulfur, a contrast increasing effect can further preferably be obtained.

The above-mentioned chemical sensitizing step includes a chemical sensitization starting step for the former and a chemical sensitization stopping step for the latter. The former means a step of adding a chemical sensitizer in which a point of time when the sensitizer is added means a point of time when the chemical sensitization is started. The latter means a step of adding an agent for stopping chemical sensitization. In the above-mentioned cases, the elementary sulfur may be added at any point of time in the course of substantially carrying out the chemical sensitization stopping step. To be more concrete, such points of time when adding the elementary sulfur include the same point of time as that when adding the chemical sensitization stopping agent, that is that when stopping the chemical sensitization, or a point of time within 10 minutes or shorter before or after stopping the sensitization and, more preferably, the same point of time or a point of time within 5 minutes or shorter before or after stopping the sensitization.

Such elementary sulfur may be added into not only silver halide emulsions but also the other photographic component layers than the emulsion layers, such as a protective layer, an interlayer, a filter layers and so forth.

In the case of adding the elementary sulfur into such a photographic component layer as those given above, it is preferable to add it in an amount 1.5 to 3 times more than the amount thereof added into a silver halide emulsion layer.

The foregoing chemical sensitization may be carried out by making use of a chemical sensitizer. The chemical sensitizers applicable to this invention include, for example, a chalcogen sensitizer.

Such chalcogen sensitizer is a generic name of a sulfur sensitizer, a selenium sensitizer and a tellurium sensitizer. As for those for photographic use, the sulfur sensitizers and selenium sensitizers should be preferably used.

As for the sulfur sensitizers, those publicly known may be used. They include, for example, a thiosulfate, allylthiocarbazide, thiourea, allylisothiocyanate, cystine, p-toluenethiosulfonate and rhodanine. Besides the above, also used may be the sulfur sensitizers such as those described in, for example, U.S. Pat. Nos. 1,574,944, 2,410,689, 2,278,947, 2,728,668, 3,501,313 and 3,656,955; West German Patent (OLS) No. 1,422,869; Japanese Patent O.P.I. Publication Nos. 56-24937/1981 and 55-45016/1980; and so forth.

The amounts of the sulfur sensitizers to be added will be varied considerably depending on the various conditions such as pH values, temperatures, silver halide grain sizes and so forth. The preferable rough standard of the amount added is of the order of about $10^{-7}$ mol to $10^{-1}$ mol per mol of silver halide used.

Selenium sensitizers may be used in place of the sulfur sensitizers. Such selenium sensitizers include, for example, aliphatic isoselenocyanates such as allylisoselenocyanate, selenoureas, selenoketones, selenoamides, selenocarboxylic acids and the esters thereof, selenophosphates, and selenides such as diethyl selenide, diethyl diselenide, and so forth. More concrete examples thereof are given in. for example, U.S. Pat. Nos. 1,574,944, 1,602,592 and 1,623,499, and so forth.

Further, a reduction sensitization may also be carried out independently or in combination. There is no special limitation to the reducing agents, however, the reducing agents include, for example, stannous chloride, thiourea dioxide, hydrazine, polyamine and so forth each of which has been publicly known and, besides, noble-metal compounds such as gold compounds, platinum compounds, palladium compounds and so forth.

Among the above-mentioned chemical sensitizations, the sulfur or gold sensitization and a gold-sulfur sensitization are preferable. In particular, the gold sensitization is preferable in the case of a blue-sensitive emulsions and the gold-sulfur sensitization in the cases of green- or red-sensitive emulsions, respectively.

In this invention, the conditions required for carrying out a chemical sensitization are varied according to silver halide grains and the photographic characteristics to be expected. As for the rough standards of the conditions, a temperature may be from 35° C. to 70° C., a pH from 0.5 to 7.5 and a pAg from 6.0 to 8.5, respectively. A period of time for carrying out a chemical sensitization may be determined in such a manner that photographic characteristics are examined time-stepwise in advance under prescribed conditions of the chemical sensitization so as to selectively determine a period of time for which the most preferable photographic characteristics such as a low fogginess, a high sensitivity, a high contrast and so forth may be displayed. For the determination, a manufacturing stability, a working efficiency required for manufacturing processes and so forth may also be considered very often. Therefore, the rough standard for such chemical sensitization time would be from several tens of minutes to several hours.

As for the stabilizers to be added into a silver halide photographic light-sensitive material relating to the invention, those publicly known may be used so as to stabilize the characteristics of the light-sensitive material in the course of manufacturing the light-sensitive material from a point of time when completing a chemical ripening step and in the course of storing the light-sensitive material from a point of time when it is manufactured to a point of time when it is actually used. Those compounds publicly known as stabilizers or antifoggants include the following compounds, for example.

Azoles such as benzothiazolium salts, nitroimidazoles, nitrobenzimidzoles, chlorobenzimidazoles, bromobenzimidazoles, mercaptothiazoles, mercaptobenzthiazoles, mercaptobenzimidazoles, mercaptothiadiazoles, aminotriazoles, benzotriazoles, nitrobenzotriazoles, polyhydroxybenzenes. mercaptotetrazoles and so forth: mercaptopyrimidines; mercaptotriazines including such a thioketo compounds as oxazolinthione; azaindenes such as triazaindenes, tetrazaindenes, pentaazaindenes and so forth benzenethiosulfonic acid; benzenesulfonic acid benzenesulfonic acid amide; and so forth.

It is preferable when using a certain kind of nitrogen-containing heterocyclic compound for the stabilizers and elementary sulfur in combination, because the effects may be enhanced. Such nitrogen-containing heterocyclic compounds applicable for this purpose include the compounds represented by the following Formula III.

Formula III

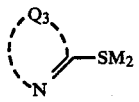

wherein $Q_3$ represents a group of complete a 5-membered heterocyclic ring or a 5-membered heterocyclic ring condensed with a benzene ring, which are allowed to have a substituent; and $M_2$ represents a hydrogen atom, an alkali metal atom or ammonium group.

The 5-membered heterocyclic rings completed by $Q_3$ denoted in Formula III include, for example, a ring of imidazole, tetrazole, thiazole, oxazole, selenazole, benzoimidazole, naphthoimidazole, benzothiazole, naphthothiazole, benzoselenazole, naphthoselenazole, benzoxazole, or the like.

Among the compounds represented by Formula III, the particularly preferable compounds may be represented by the following Formulas IIIa and IIIb.

Formula IIIa

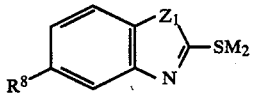

wherein $R^8$ represents a hydrogen atom, an alkyl group, an aryl group, a halogen atom, a carboxyl group or the salt thereof, a sulfo group or the salts thereof, an amino group, or an alkoxyl group; and $Z_1$ represents —NH—, —O— or —S—.

Formula IIIb

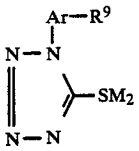

wherein Ar represents a e group, a naphthyl group, or a cyclohexyl group; $R^9$ represents a hydrogen atom, an alkyl group, an alkoxy group, a carboxyl group or the salts thereof, group or the salts thereof, a hydroxy group, an amino group, an acylamino group, a carbamoyl group, or a sulfoamido group.

More concrete examples of the compounds represented by Formulas IIIa and IIIb will now be given below. It is, however, the matter of course that the invention shall not be limited thereto.

III a-1

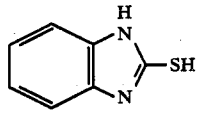

III a-2

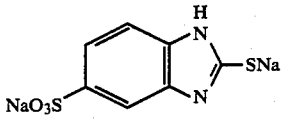

III a-3

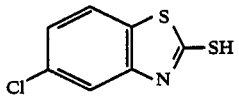

III a-4

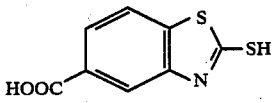

III a-5

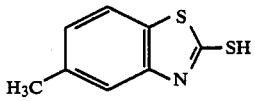

III a-6

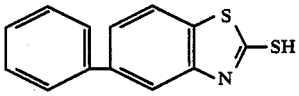

III a-7

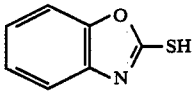

III a-8

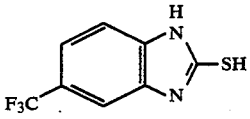

III b-1

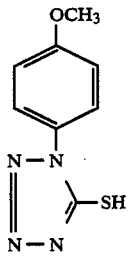

III b-2

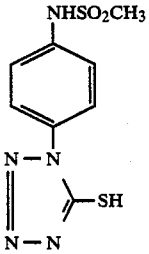

-continued

III b-3

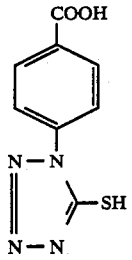

III b-4

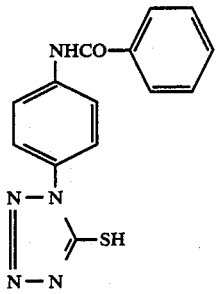

III b-5

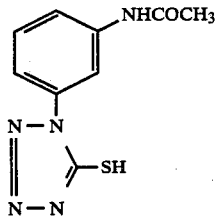

III b-6

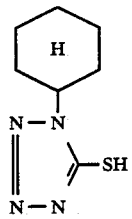

III b-7

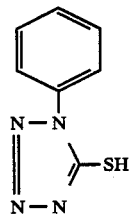

Among the above-given mercapto compounds, the mercaptotetrazole compounds such as those represented by Formula IIIb are preferable. The above-given compounds may be synthesized with reference to 'Journal of Chemical Society', 49, 1748, 1927; 'Journal of Organic Chemistry', 39, 2469, 1965; Japanese Patent O.P.I. Publication No. 50-89034/1975; 'Annalen der Chemie (Liebigs)', 44-3, 1954; Japanese Patent Examined Publication No. 40-8496; 'Chemische Berichte', 20, 231, 1887; U.S. Pat. No. 3,259,976; and so forth.

The above-mentioned nitrogen-containing heterocyclic compounds may be added either at the same time as or before or after that of adding elementary sulfur. Furthermore, for example, the nitrogen-containing heterocyclic cyclic compound may be added in the course of carrying out a silver halide grain forming step and the elementary sulfur may be added in the course of carrying out a chemical sensitizing step, separately in two or more steps.

A preferable amount of those compounds to be added in a chemical sensitization completing step should be from $10^{-6}$ mol to $10^{-2}$ mol per mol of silver halide used and, more preferably, from $10^{-5}$ mol to $5\times10^{-3}$ mol. In the case of carrying out a chemical sensitization in the presence of those compounds, the amount added should preferably be from $10^{-5}$ mol to $5\times10^{-4}$ mol per mol of silver halide.

Those compounds may be added in any of the publicly known methods. A popular method is to add them upon dissolving them in advance in water or such a water-miscible organic solvent as methanol, ethanol or the like.

There is no special limitation to the amounts of the compounds to be added in a coating solution preparing step. However, in the case of adding them into any other photographic component layers than the foregoing emulsion layers, they may be added in an amount within the range of from $1\times10^{-9}$ mol/m$^2$ to $1\times10^{-3}$ mol/m$^2$ into a coated layer.

It is preferable to add those compounds in the coating solution preparing step.

There is no special limitation to the silver halide composition of light-sensitive silver halide grains applicable to the invention. Therefore any of silver chloride, silver bromide, silver iodide, silver chlorobromide, silver iodobromide and silver chloroiodo bromide and mixtures thereof may be used.

However, for the purpose of making the invention more effective, silver halide emulsions relating to the invention should preferably contain iodides in an amount of not more than 0.5 mol %, that is, the emulsions should substantially be comprised of silver chlorobromide.

As far as a silver chlorobromide content is concerned, a highly chloride-containing silver halide emulsion comprising silver chloride in an amount of at least 80 mol % is preferable, because it is suitable for a rapid processing, and, a silver chlorobromide emulsion containing silver chloride in an amount of from 98 mol % to 99.9 mol % is more preferable. Distribution of other silver halides than silver chloride in a silver halide grain shall not specially be limitative, but may be either locally distributed in such a place as the center portion of a silver grain, the intermediate portion between the center and surface thereof and the surface thereof, or uniformly distributed. The uniform distribution thereof is preferred.

A preferable grain size of the silver halides applicable to the invention should be not larger than 1 μm. An average grain size thereof may be expressed as follows. In the case of a cubic-shaped silver halide grain, the silver halide grain size is expressed by the length of one side of the cube. In the case of a silver halide grain having the shapes, such as the globular-shape, other than the cubic-shape, the grain size is expressed by the length of one side of a cube having the same volume as that of the grain. When a size of individual grain is represented by ri and the number of grains each having a grain size ri is represented by ni, an average grain size $\bar{r}$ may be obtained by the following formula.

$$\bar{r} = \frac{\Sigma\, ni\, ri}{\Sigma\, ni}$$

The grain size distribution of silver halide grains applicable to the invention may be either of polydisperse type or of monodisperse type. It is, however, preferable that emulsions should not be of polydisperse type but of monodisperse type. In the grain size distribution of silver halide grains contained in an emulsion, the term, a 'monodisperse' type emulsion, means an emulsion having a coefficient of grain size distribution variation of not more than 22% and more preferably not more than 15%. The above-mentioned variation coefficient means a coefficient indicating a broadness of a grain size distribution, which is defined by the following equations.

$$\text{Variation coefficient} = \frac{\text{Standard deviation of grain size distribution}}{\text{Average grain size}} \times 100\%$$

$$\text{Standard deviation of grain size distribution} = \sqrt{\frac{\Sigma\, (ri - r)^2\, ni}{\Sigma\, ni}}$$

The above-mentioned grain sizes may be measured in any of various methods generally used for the same purpose as above in the technical fields of the art. Some typical methods thereof are described in, for example, R. P. Lovelend, 'Particle-Size Measurement', ASTM Symposium on Light Microscopy, 1955, pp. 94–122; Or C. E. Kenneth Mees and T. H. James, 'The Theory of the Photographic Process', 3rd Ed, The Macmillan Company, 1966, Chapter 2.

In silver halide emulsions of the invention, silver halide grains prepared in any of an acidic method, a neutral method and an ammoniacal method may be used. Those grains may be grown at a time or may be grown after seed grains are produced. Such seed grains may be produced or grown in either the same process or the different processes.

When preparing a silver halide emulsion, halide ions and silver ions may be mixed up at the same time, or one is mixed in a solution containing the other. The grains may be produced by gradually adding halide ions and silver ions at the same time, with controlling the pH and pAg values in a mixing vessel and taking the critical growth rate of silver halide crystals into consideration.

In the above-mentioned methods, it is possible to produce monodisperse type silver halide grains having a regular crystal form and a nearly uniform grain size.

For the silver halide grains relating to the invention, those having a cubic crystal habit are generally used. It is, however, allowed to use those having any of such regular crystal forms as an octahedral, tetradecahedral or the like crystal form each of which may be crystallized by making various compounds present in the course of growing the grains; those having the above-mentioned crystal habits, whose portions of edges or nuclei are rounded off; or those having such irregular crystal forms such as a globular or tabular form. To those crystallized grains, any ratio of [100] face to [111] face may be applied. Those grains may be also have various complex crystal forms or may be mixed with grains having various crystal forms.

It is desirable to use such cubic-formed grains are used in the invention because a relatively higher sensitivity may be obtained.

As for the silver halide emulsions of the invention, a mixture of not less than two kinds of silver halide emulsions separately prepared may be used.

The silver halide grains applicable to the silver halide emulsions of the invention may be contained with a metal ion inside and/or outside the grains in such a manner that metal ions are added with at least one metal salt selected from the group consisting of a cadmium salt, a zinc salt, a lead salt, a thallium salt, an iridium salt including the complex salts thereof, a rhodium salt including the complex salts thereof and an iron salt including the complex salts thereof in the course of producing and/or growing the grains. Those grains each may also be provided inside and/or outside thereof with reduction-sensitizing nuclei, by putting them in a suitable reducible atmosphere.

Silver halide emulsions of the invention may be optically sensitized to a desired wavelength region by making use of a dye which has been known as a sensitizing dye in the photographic art. Such sensitizing dyes may be used either independently or in combination. The emulsions may also contain a dye not having any spectral sensitizing function in itself together with the sensitizing dye, or a super-sensitizer that is a compound substantially incapable of absorbing any visible rays of light, but is capable of enhancing the sensitizing function of the sensitizing dye.

Further, those sensitizing dyes may be used with the purposes of controlling contrast and development, besides their original spectrally sensitizing purpose.

Such sensitizing dyes include, for example, a dye of cyanine, merocyanine, complex cyanine, complex merocyanine, holopolar cyanine, hemicyanine, styryl, hemioxanol or the like.

Among those, the particularly useful dyes include, for example, a dye of cyanine, merocyanine and complex merocyanine.

The above-given dyes may have any of nuclei usually used for cyanine dyes which are popularly utilized as the basic heterocyclic nuclei. Those nuclei include, for example, a nucleus of pyrroline, oxazoline, thiazoline, pyrrole, oxazole, thiazole, selenazole, imidazole, tetrazole or pyridine and the nuclei each condensed with an alicyclic hydrocarbon ring: and those nuclei each condensed with an aromatic hydrocarbon ring such as a nucleus of indolenine, benzindolenine, indole, benzoxazole, naphthoxazole, benzothiazole, naphthothiazole, benzoselenazole, benzimidazole, quinoline or the like. Those nuclei may be substituted on a carbon atom.

The merocyanine dye or complex merocyanine dye may be appliwed with such a 5- or 6-membered heterocyclic nucleus as a nucleus of pyrazoline-5-one, thiohydantoine, 2-thiooxazolidine-2,4-dione, thiazolidine-2,4-dione, rhodanine, thiobarbituric acid or the like, so as to serve as a nucleus having a ketomethylene structure.

The sensitizing dyes usefully applicable to a blue-sensitive silver halide emulsion layer include, for example, those represented by the following Formula IV, which are preferable from the viewpoint of pressure resistance.

Formula IV

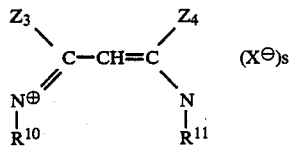

wherein $Z_3$ and $Z_4$ each represent a group of atoms necessary to complete a nucleus of oxazole, thiazole, selenazole, pyridine, benzoxaazole, benzoselenazole, benzimidazole, naphthoxazole, naphthothiazole, nephthoselenazole, naphthoimidazole or quinoline; $R^{10}$ and $R^{11}$ each represent a group selected from the group consisting of an alkyl group, an alkenyl group or an aryl group; $X^{\ominus}$ represents an anion; and s represents an integer of 0 or 1.

In the blue-sensitive spectrally sensitizing dyes represented by the foregoing Formula IV, the heterocyclic nuclei represented by $X_3$ and $Z_4$ include, preferably, a nucleus of thiazole, selenazole, benzothiazole, benzoselenazole or naphthothiazole, more preferably, a nucleus of benzothiazole or benzoselenazole and, most preferably, a nucleus of benzothiazole.

The heterocyclic nuclei represented by $Z_3$ and $Z_4$ are allowed to have a substituent. Such substituents include, for example, a halogen atom or a group of hydroxyl, cyano, aryl, alkyl or alkoxy, and so forth. Among the halogen atoms, a chlorine atom is particularly preferable. Among the aryl groups, a phenyl group is preferable.

The alkyl groups include, preferably, a straight-chained or branched ones each having 1 to 4 carbon atoms, such as a group of methyl, ethyl, propyl, isopropyl, butyl or the like. Among those, the methyl group is preferable. The alkoxy groups include, preferably, those each having 1 to 4 carbon atoms, such as a group of methoxy, ethoxy or propoxy. Among those, a methoxy group is preferable.

The alkyl groups represented by $R^{10}$ and $R^{11}$ include, preferably, straight-chained or branched ones each having I to carbon atoms, such as a group of methyl, ethyl, propyl, isopropyl or the like. Those alkyl groups may be substituted. Such substituents include, preferably, a group of sulfo, carboxyl, hydroxyl, alkoxycarbonyl, alkylsulfonylamino or the like. More concretely, they include, for example, a group of 2-sulfoethyl, 3-sulfopropyl, 4-sulfobutyl, 3-sulfobutyl, carboxyl, 2-carboxyethyl, 2-ethoxycarbonylethyl, 2-hydroxyethyl, 2-methylsulfonylaminoethyl or the like. The alkyl groups represented by $R^{10}$ and $R^{11}$ include, preferably, those each substituted with a group of sulfo carboxyl. Organic ion group, i.e., a group of sulfo, carboxyl or the like may also produce a salt together with inorganic cations such as an ion of ammonium. sodium, potassium or the like.

The anions represented by $X^{\ominus}$ include, preferably, an ion of chlorine, bromine, iodine, p-toluene sulfonic acid or the like and, more preferably, a halogen ion. When producing an intramolecular salt, an anion need not be present and then s represents zero.

The foregoing blue-sensitive sensitizing dyes have been generally known, so that they may readily be synthesized in such a method as described in F. M. Hamer, 'The Cyanine Dyes and Related Compounds', Interscience Publishers, N.Y., 1969.

Next, some of the concrete examples of the blue-sensitive sensitizing dyes represented by the foregoing Formula IV will be given below. It is, however, to be understood that the invention shall not be limited thereto.

IV-1

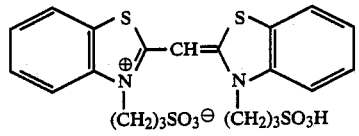

IV-2

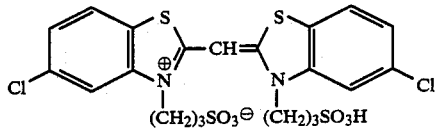

IV-3

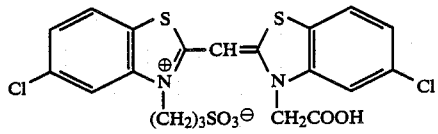

IV-4

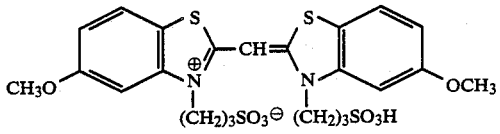

IV-5

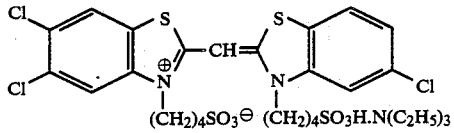

IV-6

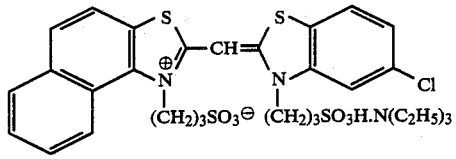

IV-7

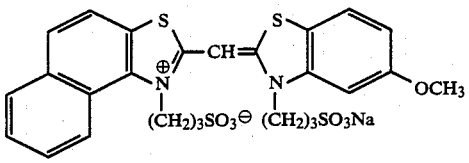

IV-8

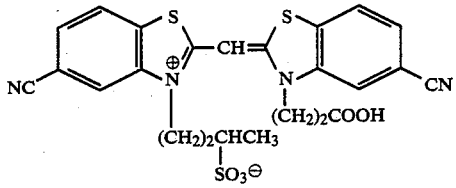

IV-9

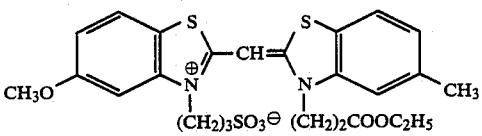

-continued

IV-10

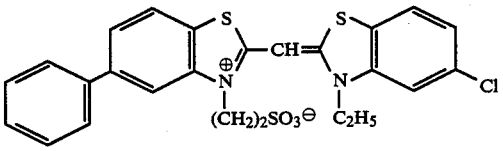

IV-11

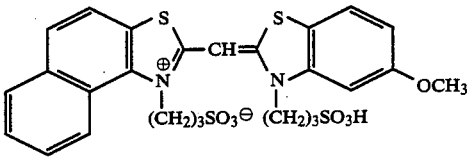

IV-12

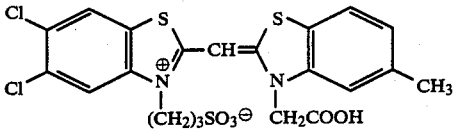

IV-13

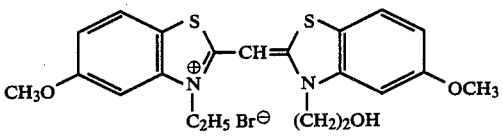

IV-14

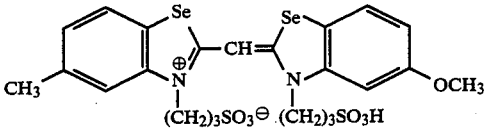

IV-15

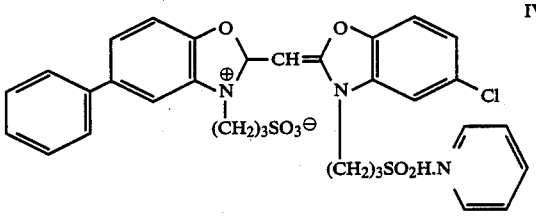

IV-16

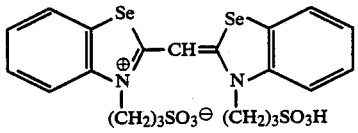

IV-17

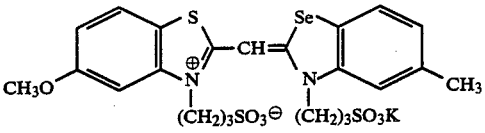

IV-18

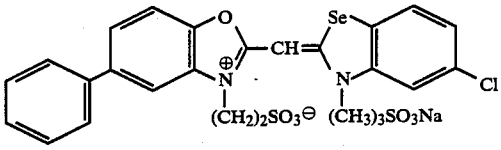

-continued

IV-19

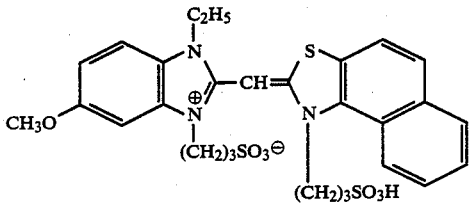

IV-20

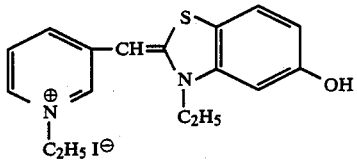

The sensitizing dyes usefully applicable to a green-sensitive silver halide emulsion include, typically, a dye of cyanine, merocyanine or complex cyanine, of which described in, for example. U.S. Pat. Nos. 1,939,201, 2,071,908, 2,739,149 and 2,945,763; British Patent No. 505,979; and so forth. Further, the sensitizing dyes usefully applicable to a red-sensitive silver halide emulsion include, typically, a dye of cyanine, merocyanine or complex cyanine, of which described in, for example, U.S. Pat. Nos. 2,269,234, 2,270,378, 2,442,710, 2,454,629 and 2,776,280; and so forth. Further,the dyes of cyanine, amerocyanine and complex cyanine described in U.S. Pat. Nos. 2,213,995, 2,493,748 and 2,519,001; West German Patent No. 929,080; and so forth are advantageously applied to a green or red light-sensitive silver halide emulsion.

The above-mentioned sensitizing dyes may be used independently or in combination. The combination thereof is often used especially with the purpose of supersensitization.

The typical examples thereof are given in Japanese Patent Examined Publication Nos. 43-4932/1968, 43-4933/1968, 43-4936/1968, 44-327531969, 45-25831/1970, 45-26747/1970, 46-11627/1971, 46-181071971, 47-87411972, 47-111141972, 47-25371972, 47-37443/1972, 48-282931973, 48-384061973, 48-384071973, 48-38408/1973, 48-41203/1973, 48-41204/1973, 49-6207/1974, 50-40662/1975, 53-12375/1978, 54-34535/1979 and 55-1569/1980; Japanese Patent O.P.I. Publication Nos. 50-33220/1975, 50-33828/1975, 50-38526/1975, 51-107127, 51-107127/1976, 51-115820/1976, 51-135528/1976, 51-151627/1976, 52-23931/1977, 52-51932/1977, 52-104916/1977, 52-104917/1977, 52-109925/1977, 52-110618/1977, 54-80118/1979, 56-25728/1981, 57-1483/1982, 58-10753/1983, 58-91445/1983, 58-153926/1983, 59-114533/1984, 59-116645/1984 and 59-116647/1984; and U.S. Pat. Nos. 2,688,545, 2,977,229, 3,397,060, 3,506,443, 3,578,447, 3,672,898, 3,679,428, 3,769,301, 3,814,609 and 3,837,862.

A dye which does not have any spectral sensitizing function in itself together but is used together with the sensitizing dye, or a super-sensitizer that is a compound substantially incapable of absorbing any visible rays of light but is capable of enhancing the sensitizing function of the sensitizing dye, include, for example, aromatic organic acid formaldehyde condensates such as those described in U.S. Pat. No. 3,437,510; aminostilbene compounds each substituted with a cadmium salt, an azaindene compound or a nitrogen-containing heterocyclic group, such as those described in U.S. Pat. Nos. 2,933,390 and 3,635,721; and so forth. Inter alia, the particularly useful ones include, for example, the combinations described in U.S. Pat. Nos. 3,615,613, 3,613,641, 3,617,295 and 3,635,721.

Gelatin may be advantageously used for a binder or a protective colloid of silver halide emulsions of the invention. Besides the gelatin, hydrophilic colloids including, for example, a gelatin derivative, a graft polymer of gelatin and other macromolecular substances, other proteins, a sugar derivative, a cellulose derivative, such a synthetic hydrophilic macromolecular substance as a homo- or co-polymer, and so forth may be used.

As for the gelatin, it uses lime-treated gelatin and, besides, acid-treated gelatin and enzyme-treated gelatin such as described in 'Bulletin of Society of Science, of Photography of Japan', No. 16, p. 30, 1966, may be used. Further, a hydrolyzed product or enzyme-decomposed product of gelatin may also be used.

As for the gelatin derivatives, obtained by reacting gelatin with such a variety of compounds as an acid halide, an acid anhydride, an isocyanate, a bromoacetic acid, an alkanesultone, a vinylsulfonamide, a maleinimide compound, a polyalkyleneoxide, an epoxy compound and so forth, may be used. The concrete examples thereof are described in, for example. U.S. Pat. Nos. 2,614,928, 3,132,945, 3,186,846 and 3,312,553; British Patent Nos. 861,414, 1,033,189 and 1,005,784; Japanese Patent Examined Publication No. 42-2684/1967; and so forth.

The preferable proteins include, for example, albumin and casein; the preferable cellulose derivatives include, for example, hydroxyethyl cellulose, carboxymethyl cellulose and a cellulose sulfate; and the preferable sugar derivatives include, for example, sodium alginate and starch derivatives.

As for the graft polymers of gelatin and other macromolecular substance, those of gelatin grafted together with acrylic acid or methacrylic acid and the esters thereof, a derivative of amide or the like, or a homo- or co-polymer of vinyl monomer, such as acrylonitrile, styrene and so forth, may be used. In particular, the preferable graft polymers include, for example, those of gelatin and such a polymer as those of acrylic acid, acrylamide, methacrylamide, hydroxyalkyl methacrylate and so forth, each of which is compatible to some extent to the gelatin. The above-given examples are described in U.S. Pat. Nos. 2,763,625, 2,831,767 and 2,956,884; and so forth.

The typical synthetic hydrophilic macromolecular substances include, for example, homo- or co-polymers of polyvinyl alcohol, partially acetalizated polyvinyl alcohol poly-N-vinyl pyrolidone, polyacrylic acid, polymethacrylic acid, polyacrylamide, polyvinyl imidazole, polyvinyl pyrazole and so forth. They are described in, for example, West German (OLS) Patent No. 2,312,708; U.S. Pat. Nos. 3,620,751 and 3,879,205; and Japanese Patent Examined Publication No. 43-7561/1968.

In the case that a silver halide emulsion of the invention is used in a color photographic light-sensitive material, there uses a dye-forming coupler capable of forming a coupler upon coupling reaction, in a color developing step, with the oxidized product of such an aromatic primary amine developing agent as a derivative of p-phenylenediamine, aminophenol or the like. Such dye-forming couplers are usually so selected as to form a dye capable of absorbing a photospectrum corresponding to aspectral sensitivity of each emulsion layer, so that a yellow dye-forming coupler is used for a blue-sensitive emulsion layer, a magenta dye-forming coupler for a green-sensitive emulsion layer and a cyan dye-forming coupler for a red-sensitive emulsion layer, respectively. However, a color photographic light-sensitive material may be prepared in a different manner from the above-mentioned combination of couplers and layers, according to various purposes of use.

It is desirable that the foregoing dye-forming couplers each contain, in the molecules thereof, the so-called ballast group, that is, a group which has not less than 8 carbon atoms and is capable of inhibiting couplers from diffusing. Such dye-forming couplers each may be of either the 4-equivalent type for which silver ions of four molecules should necessarily reduced to form a dye of one molecule or the 2-equivalent type for which silver ions of only two molecules may be reduced.

The dye-forming couplers may also contain a compound capable of releasing such a photographically useful fragment as a development accelerator, a bleach accelerator, a developing agent, a silver halide solvent, a color toner, a hardener, a foggant, an antifoggant, a chemical sensitizer, a spectral sensitizer and a desensitizer, upon coupling to the oxidized product of a developing agent.

Those dye-forming couplers may also be used together with a colored couplers each having a color-correction effect or a DIR coupler capable of improving image sharpness or image graininess by releasing a developing inhibitor with development. In this case, it is rather preferred that the dye formed of a DIR coupler used in an emulsion layer and the dye formed of a dye-forming coupler used in the same emulsion layer should be the same in color. However such a DIR coupler and such a dye-forming coupler each may form the different kinds of dyes, provided that a resulting color-contamination is not conspicuous.

In place of or in combination with the foregoing DIR coupler, another DIR compound which is capable of producing a colorless compound and at the same time releasing a development inhibitor, upon coupling reaction with the oxidized product of a developing agent, may be used.

The DIR couplers and the DIR compounds each applicable to the above case include also those in which an inhibitor is coupled directly to the coupling position and those in which an inhibitor is coupled to the coupling position through a divalent group so as to be released upon intramolecular nucleophilic reaction, intramolecular electron-transfer reaction or the like which takes place in a group having been split off upon coupling reaction, which are so-called a timing DIR coupler and a timing DIR compound, respectively. It may be that two kinds of the inhibitors, one diffusible after splitting off and the other not so diffusible thereafter, are selectively used independently or in combination. A colorless coupler which forms a coupling reaction with the oxidized product of an aromatic primary amine developing agent but is incapable of forming any dye may be used with dye-forming coupler.

Preferably applicable yellow dye-forming couplers include, for example, a variety of acylacetoanilide type couplers. Among those, a benzoylacetoanilide type and pivaloylacetoanilide type compounds are advantageously applicable. The typical examples of applicable yellow couplers are described in, for example, British Patent No. 1,077,874; Japanese Patent Examined Publication No. 45-40757/1970; Japanese Patent O.P.I. Publication Nos. 47-1031/1972, 47-26133/1972, 48-94432/1973, 50-87650/1975, 51-3631/1976, 52-115219/1977, 54-99433/1979, 54-133329 and 56-30127/1981; U.S. Pat. Nos. 2,875,057, 3,253,924, 3,265,506, 3,408,194, 3,551,155, 3,551,156, 3,664,841, 3,725,072, 3,730,722, 3,891,445, 3,900,483, 3,929,484, 3,933,500, 3,973,968, 3,990,896, 4,012,259, 4,022,620, 4,029,508, 4,057,432, 4,106,942, 4,133,958, 4,269,936, 4,286,053, 4,304,845, 4,314,023, 4,336,327, 4,356,258, 4,386,155 and 4,401,752; and so forth.

Preferably applicable magenta dye-forming couplers include, for example, 5-pyrazolone type couplers. pyrazolobenzimidazole type couplers, pyrazoloazole type couplers and open-chained acylacetonitrile type couplers. The concrete examples of the advantageously applicable magenta couplers include those described in, for example, Japanese Patent O.P.I. Publication Nos. 60-55343/1985, 60-98434/1985, 60-108847/1985 and 60-168143/1985; Japanese Patent Examined Publication Nos. 40-6031/1965, 40-6035/1965, 45-40757/1970, 47-27411/1972 and 49-37854/1974; Japanese Patent O.P.I. Publication Nos. 50-13041, 51-26541/1975, 51-37646/1976, 51-105820/1976, 52-42121/1977, 53-123129/1978, 53-125835/1978, 53-129035/1978, 54-48540/1979, 56-29236/1981, 56-75648/1981, 57-17950/1982, 57-35858/1982, 57-146251/1982 and 59-99437/1984; British Patent No. 1,252,418, U.S. Pat. Nos. 2,600,788, 3,005,712, 3,062,653, 3,127,269, 3,214,437, 3,253,924, 3,311,476, 3,419,391, 3,519,429, 3,558,319, 3,582,322, 3,615,506, 3,658,544, 3,705,896, 3,725,067, 3,758,309, 3,823,156, 3,834,908, 3,891,445, 3,907,571, 3,926,631, 3,928,044, 3,935,015, 3,960,571, 4,076,533, 4,133,686, 4,237,217, 4,241,168, 4,264,723, 4,301,235 and 4,310,623; and so forth.

Preferably applicable cyan dye-forming couplers include, for example, naphthol type couplers and phenol couplers. The concrete examples of advantageously applicable cyan couplers include those described in, for example, British Patent Nos. 1,038,331 and 1,543,040; Japanese Patent Examined Publication No. 48-36894/1973; Japanese Patent O.P.I. Publication Nos. 48-59838/1973, 50-137137/1975, 51-146828/1976, 53-105226/1978, 54-115230/1979, 56-29235/1981, 56-104333/1981, 56-126833/1981, 57-133650/1982, 57-155538/1982, 57-204545/1982, 58-118643/1983, 59-31953/1984, 59-31954/1984, 59-59656/1984, 59-1243411094 and 59-166956/1984; U.S. Pat. Nos. 2,369,929, 2,423,730, 2,434,272, 2,474,293, 2,698,794, 2,772,162, 2,801,171, 2,895,826, 3,253,924, 3,311,476, 3,458,315, 3,476,563, 3,591,383, 3,737,316, 3,758,308, 3,767,411, 3,790,384, 3,880,661, 3,926,634, 4,004,929, 4,009,035, 4,012,258, 4,052,212, 4,124,396, 4,134,766, 4,138,258, 4,146,396, 4,149,886, 4,178,183, 4,205,990, 4,254,212, 4,264,722, 4,288,532, 4,296,199, 4,296,200, 4,299,914, 4,333,999, 4,334,011, 4,386,155 and 4,401,752 and 4,427,767; and so forth.

Besides the above-given compounds, a variety of photographic additives may also be added into the silver halide photographic light-sensitive materials each containing the silver halide emulsion of the invention.

Such photographic additives include, for example. UV absorbents such as a benzophenone type compound, benzotriazole type compounds, and so forth; development accelerators such as a 1-aryl-3--pyrazolidone type compound and so forth: surface active agents such as an alkylnaphthalene sulfonate, an alkylsulfosuccinate, an itaconate, a polyalkylene oxide type compound and so forth; water-soluble soluble anti-irradiation dye such as an azo type compound, a styryl type compound, an oxonoltype compound, an anthraquinone type compound, a triphenylmethane type compound and so forth: agents for improving layer physical properties such as glycerol, a polyalkylene glycol, a polymer latex, a solid or liquid paraffin, and so forth; color-contamination inhibitors such as a diffusion-resistive hydroquinone type compound and so forth; dye-image stabilizers such as a hydroquinone derivative, a gallic acid derivative, a phenol type compound, a hydroxychroman type compound, a polyalkyl piperidine type compound, an aromatic amine type compound and so forth; water-soluble or oil-soluble optical brightening agents; background toning agents such as an oil-soluble coloring dyestuff and so forth; and so forth.

Among the dye-forming couplers, colored couplers, DIR couplers, DIR compounds, image-stabilizers, color-contamination inhibitors, UV absorbents, optical brightening agents and so forth, the hyrophobic compounds may be treated in various methods such as a solid-dispersion method, a latex-dispersion method, an oil drop-in-water type emulsification-dispersion method and so forth. A suitable method may be selected from those methods according to the chemical structures or the like of such a hydrophobic compound as couplers and so forth. Such oil drop-in-water type emulsification-dispersion methods include, for example, a variety of methods each in which hydrophobic compounds such as couplers are dispersed. In those methods, a hydrophobic compound is usually dissolved in a high boiling organic solvent having a boiling point of not lower than about 150° C. and, if required, together with a low-boiling and/or water-soluble organic solvent. The resulting solution is emulsified and dispersed in such a hydrophilic binder as a gelatin solution together with a surface active agent by making use of such a dispersing means as a stirrer, a homogenizer, a colloid mill, a flow-jet mixer, a supersonic means or the like, and the resulting emulsified dispersed matter may be added into an objective hydrophilic colloidal layer. A step for removing the low-boiling organic solvent may further be added after or at the same time when the dispersion is made.

The proportion of the high boiling organic solvent to the low-boiling organic solvent is from 1:0.1 to 1:50 and, more preferably, from 1:1 to 1:20.

As for the high boiling solvents, organic solvents each having a boiling point of not lower than 150° C. which are incapable of reacting with the oxidized product of a developing agent, a phenol derivative, a alkylphthalate, a phosphate, a citrate, a benzoate, an alkylamide, a fatty acid ester, a trimesic acid ester and so forth may be used.

The applicable high-boiling organic solvents include, those described in, for example. U.S. Pat. Nos. 2,322,027, 2,533,514, 2,835,579, 3,287,134, 2,353,262, 2,852,383, 3,554,755, 3,676,137, 3,676,142, 3,700,454, 3,748,141, 3,779,765 and 3,837,863; British Patent Nos. 958,441 and 1,222,753; West German OLS Patent No. 2,538,889; Japanese Patent O.P.I. Publication Nos. 47-1031/1972, 49-90523/1974, 50-23823/1975, 51-26037/1976, 51-27921/1976, 51-27922/1976, 51-26035/1976, 51-26036/1976, 50-62632/1975, 53-1520/1978, 53-15211978, 53-151281089. 54-1100211080. 54-119922/1979, 55-25057/1980, 55-36869/1980, 56-19049/1981 and 56-81836/1981; Japanese Patent Examined Publication No. 48-29060/1973; and so forth.

The low-boiling or water-soluble organic solvents which may be used together with or in place of the high-boiling solvents include those described in, for example, U.S. Pat. Nos. 2,801,171 and 2,949,360; and so forth. The low-boiling and substantially water-insoluble organic solvents include, for example, ethyl acetate, propyl acetate, butyl acetate, butanol, chloroform, carbon tetrachloride, nitromethane, nitroethane, benzene and so forth. The water-soluble organic solvents include, for example, acetone, methylisobutyl ketone, β-ethoxyethyl acetate, methoxyglycol acetate, methanol, ethanol, acetonitrile, dioxane, dimethyl formamide, dimethyl sulfoxide, hexamethyl phosphoramide, diethyleneglycol monophenylether, phenoxyethanol and so forth.

Surface active agents may be used for a dispersion assistant. The preferable surface active agents include, for example, anionic surface active agents such as an alkylbenzene sulfonate, an alkylnaphthalene sulfonate, an alkyl sulfonate, an alkyl sulfate, an alkyl phosphate, a sulfosuccinate, a sulfoalkyl polyoxyethylene alkylphenyl ester and so forth; nonionic surface active agents such as a steroid type saponin an alkylene oxide derivative, a glycidol derivative and so forth; amphoteric surface active agents such as an amino acid, an aminoalkyl sulfonic acid, an alkyl betaine and so forth; and cationic surface active agents such as a quaternary ammonium salt and so forth.

More concrete examples of those surface active agents are described in, for example, 'A Handbook of Surface Active Agents'. Sangyo Tosho Publising Co.. 1966; and 'A Data Collection of Researches and Technologies on Emulsifiers and Emulsifying Apparatuses'. Kagaku Hanron Publishing Co., 1978, respectively.

Preferable latex dispersion methods are described in, for example, U.S. Pat. Nos. 4,199,363, 4,214,047, 4,203,716 and 4,247,627; Japanese Patent O.P.I. Publication Nos. 49-74538/1974, 53-59942/1976, 51-59943/1976 and 54-32552/1979; and so forth.

Photographic light-sensitive materials each containing the silver halide emulsion of the invention may be processed in any of the well-known processing methods.

Usually, in each of processing steps, a light-sensitive material is processed by dipping it in a processing solution. However, besides the above, a spray method in which a processing solution is supplied in the atomized form; a web method in which a light-sensitive material is brought into contact with a carrier pregnant with a processing solution; a method in which a viscous developing process is carried out; or the like may be used.

In a color development process, a series of processing steps are carried out, such as a color developing step, a bleaching step, a fixing step, and, if required, a washing and/or stabilizing steps. In these processing steps, may be carried out by making use of a monobath type bleach-fixer solution in place of both of the step of using a bleaching solution and the step of using a fixer, or a monobath processing step may be carried out in which each of a color development, bleaching and fixation may be performed by making use of a monobath type developing, bleaching and fixing solution.

With the combination of the above-mentioned steps, further steps may be a pre-hardening step, the neutralizing step thereof, a stopping-fixing step, a post-hardening step and so forth.

In the above-mentioned process, the color developing step may be replaced by an activator processing step in which a color developing agent or the precursor thereof is contained in advance into a light-sensitive material and the development is then made with an activator solution, or, the monobath processing may be replaced by carrying out the activator processing step and a bleach and fixing steps at the same time. Among those processing steps, the typical examples thereof will be given below, provided, however, that any one of the steps of washing, stabilizing, and washing-stabilizing is to be carried out as the final processing step.

Color developing step - bleaching step - fixing step;
Color developing step - bleach-fixing step;
Pre-hardening step - neutralizing step - color developing step - stopping-fixing step - washing step bleaching step - fixing step - washing step - post-hardening step;
Color developing step - washing step - auxiliary color developing step - stopping step - bleaching step - fixing step;
Monobath processing step:
Activator processing step - bleaching-fixing step;
Activator processing step - bleaching step - fixing step;

EXAMPLES OF THE INVENTION

This invention will be more detailed with reference to the following examples. It is, however, to be understood that this invention shall not be limited thereto.

EXAMPLE-1

Silver chlorobromide emulsion Em-1 was so prepared as to have a grain size of 0.85 μm in the following manner. Into an aqueous gelatin solution being vigorously stirred was added with both of 1 liter of an aqueous solution having a silver nitrate content of 1 mol per liter and 1 liter of a solution of mixed halides which comprises potassium bromide in a proportion of 0.3 mol % and sodium chloride in a proportion of 99.7 mol % and has the halide content of 1 mol per liter.

The resulted Em-1 was added with sodium thiosulfate as a sulfur sensitizer in an amount of $8\times10^{-4}$ mol per mol of silver halide and a blue-sensitive sensitizing dye IV-3 in an amount of $3\times10^{-4}$ mol per mol of silver halide. When a chemical ripening was completed, the resulten emulsion was divided into four parts. Into the three parts thereof were added with elementary sulfur of $1\times10^{-2}$ mg, 0.1 mg and 1 mg each per mol of silver halide, respectively, and nothing was added into the remainder of the four parts. The resulted four emulsions are called Em-1-1, Em-1-2, Em-1-3 and Em-1-4, respectively.

In the same manner as above, a silver chlorobromide emulsion Em-2 was so prepared as to have a grain size of 0.40 μm, provided that there used an aqueous solution of mixed halides containing potassium bromide in an amount of 0.5 mol % and sodium chloride in an amount of 99.5 mol %. The resulted Em-2 was added with sodium thiosulfate as a sulfur sensitizer in an amount of $1\times10^{-5}$ mol per silver halide and a green-sensitive sensitizing dye GSD-1 in an amount of $2\times10^{-4}$ mol per mol of silver halide. When a chemical ripening was completed, the resulted Em-2 was divided into four parts. Into the three parts out of the four were added with elementary sulfur of $1\times10^{-2}$ mg, 0.1 mg and 1 mg each per mol of silver halide, respectively, and nothing was added into the remainder of the four parts. The resulted four emulsions are called Em-2-1, Em-2-2, Em-2-3 and Em-2-4, respectively.

In the same manner as above, a silver chlorobromide emulsion Em-3 was so prepared as to have a grain size of 0.50 μm, provided that there used an aqueous solution of mixed halides containing potassium bromide in an amount of 0.7 mol % and sodium chloride in an amount of 99.3 mol %. The resulted Em-3 was added with sodium thiosulfate as a sulfur sensitizer in an amount of $1\times10^{-5}$ mol per silver halide and a red-sensitive sensitizing dye RSD-1 in an amount of $2\times10^{-4}$ mol per mol of silver halide. When a chemical ripening was completed, the resulted Em-2 was divided into four parts. Into the three parts out of the four were added with elementary sulfur of $1\times10^{-2}$ mg, 0.1 mg and 1 mg each per mol of silver halide, respectively, and nothing was added into the remainder of the four parts. The resulted four emulsions are called Em-3-1, Em-3-2, Em-3-3 and Em-3-4, respectively.

Next, a silver halide photographic light-sensitive material was prepared by coating the following layers over a polyethylene-coated paper support. Wherein, the amount of each compound coated is expressed by a value per sq. meter.

Layer 1: A blue-sensitive emulsion layer

This layer contained a blue-sensitive emulsion shown in Table-1 in an amount of 0.35 g in terms of silver content. 0.3 g of a dinonyl phthalate dispersion dissolved therein with 0.9 g of yellow coupler Y-1 and 0.02 g of 2,5-di-t-octyl hydroquinone HQ-1, and 2.0 g of gelatin.

Layer 2: The 1st interlayer

This layer contained an emulsified dispersion prepared by dissolving 0.15 g of HQ-1 in 0.04 g of diisodecyl phthalate, and 1.5 g of gelatin.

Layer 3: A green-sensitive emulsion layer

This layer contained a green-sensitive emulsion shown in Table-1 in an amount of 0.3 in terms of silver content, 0.28 of dioctyl phthalate dispersion dissolved therein with 0.4 of magenta coupler M-1 and 0.015 g of HQ-1, and 1.5 g of gelatin.

Layer 4: The 2nd Interlayer

This layer contained 0.2 of dinonyl phthalate dispersion dissolved therein with 0.8 g of a UV absorbent UV-1 and 0.04 g of HQ-1, and 1.5 of gelatin.

Layer 5: a red-sensitive emulsion layer

This layer contained a red-sensitive emulsion shown in Table-1 in an amount of 0.25 in terms of silver content, 0.2 g of dioctyl phthalate dispersion dissolved therein with 0.15 g of cyan coupler C-1, 0.3 g of cyan coupler C-2 and 0.01 g of HQ-1, and 2.0 g of gelatin.

Layer 6: The 3rd interlayer

This layer contained 0.2 of a dinonyl phthalate dispersion dissolved therein with 0.4 g of UV-1 and 0.02 g of HQ-1, and 0.7 g of gelatin.

Layer 7: A protective layer

This layer contained 1.0 g of gelatin and a hardener I-1.

As shown in Table-I, the samples were prepared by further adding elementary sulfur into Layers 1, 3 and 5, immediately before the layers were coated.

The resulted samples were hardened by allowing them to stand for 48 hours or 96 hours long under the conditions of 38° C. and 40 % RH. Thus prepared Samples No. 1 through No. 23 were evaluated as follows.

1 Sensitivity and Gradation Evaluation

Each of the samples was exposed to light through a wedge by making use of a sensitometer Model KS-7 manufactured by Konica Corporation and was then processed to obtain yellow, magenta and cyan dye images, respectively. The resulted density of the dye images were measured with a densitometer Model PDA-65 manufactured by Konica Corporation so as to obtain both sensitivity that is a reciprocal of an exposure giving a density of 1.0 and the gradation that is an average gradient γ from density 0.7 to 1.7.

Color developed at 35° C. for 45 sec. - Bleach-fixed at 35° C. for 45 sec. - Stabilized at 30° to 40° C. for 90 sec. Dried at 60° to 80° C. for 60 sec.

| | |
|---|---|
| Composition of Color Developer | |
| Pure water | 800 ml |
| Triethanol amine | 12 ml |
| N,N-diethylhydroxylamine in an aqueous 85% solution | 12 ml |
| Potassium chloride | 2.2 g |
| Potassium sulfite | 0.2 g |
| N-ethyl-N-β-methanesulfonamidoethyl-3-methyl-4-aminoaniline sulfate | 5.0 g |
| 1-hydroxyethylidene-1,1-diphosphonic acid | 1.0 g |
| Ethylenediaminetetraacetic acid | 2.0 g |
| Water soluble optical brightening agent of diaminostilbene type | 2.0 g |
| Add pure water to make | 1 liter |
| Adjust pH to | pH = 10.1 |
| Bleach-Fixer | |
| Ferric ammonium ethylenediamine tetraacetate, dihydrate | 60 g |
| Ethylenediaminetetraacetic acid | 3 g |
| Ammonium thiosulfate, in a 70% solution | 100 ml |
| Ammonium sulfite, in a 40% solution | 27.5 ml |
| Add pure water to make | 1 liter |
| Adjust pH to | pH = 6.2 |
| Stabilizer | |
| 5-chloro-2-methyl-4-isothiazoline-3-one | 1.0 g |
| Ethylene glycol | 1.0 g |
| 1-hydroxyethylidene-1,1-diphosphonic acid | 2.0 g |
| Ethylenediaminetetraacetic acid | 1.0 g |
| Ammonium hydroxide, in a 20% solution | 3.0 g |
| Ammonium sulfite | 3.0 g |
| Optical brightening agent, 4,4'-diaminostilbene sulfonic acid derivative | 1.5 g |
| Add pure water to make | 1 liter |
| Adjust pH to | pH = 7.0 |

2 Pressure Resistance in dryness

After each sample was allowed to stand for 2 hours at 25° C. and 40% RH, a ball-point needle having a ball-diameter of 0.1 mm was put perpendicular to the horizontal surface of the sample. While moving the sample surface horizontally at a rate of 1 cm per second, a load was continuously applied, with chaging the load from 0 to 100 g, to the ball-point needle. After then each of the samples was processed in the same manner as in the above-mentioned sensitivity and gradation tests so that the loads applied to the ball-point needle were recorded each time when the densities in yellow, magenta and cyan were increased by pressure. It was evaluated that the larger a load was, the greater the pressure resistance in dryness was.

3 Pressure Resistance in Wetness

Each sample was exposed uniformly to light so as to adjust each of the yellow, magenta and cyan color desities thereof to be from 0.1 to 0.3. Each of the samples was processed in the same manner as in the foregoing sensitivity and gradation tests, except that, while the sample was being color developed at 35° C. with the foregoing color developer, a ball-point needle having a ball-diameter o 0.3 mm was put perpendicular onto the sample surface which was being dipped in the color developer and the sample surface was moved horizontally to the surface at a rate of I cm per second while a load was continuously applied to the ball-point needle with changing the load from 0 to 50 g.

The loads applied to the ball-point needle were recorded each time when the densities in yellow, magenta and cyan were increased by pressure. It was evaluated that the larger a load was, the greater the pressure resistance in wetness was.

(GSB-1)

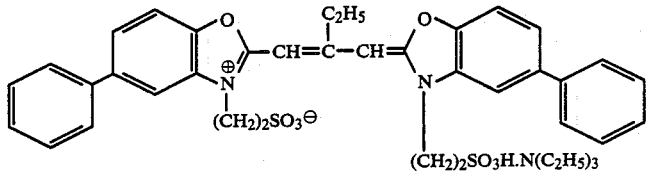

(RSD-1)

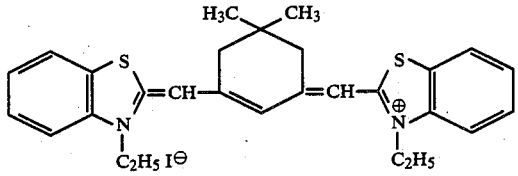

(Y-1)

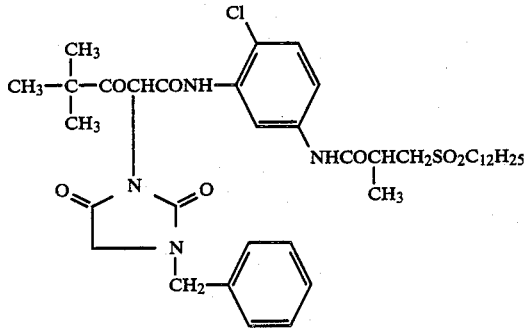

(M-1)

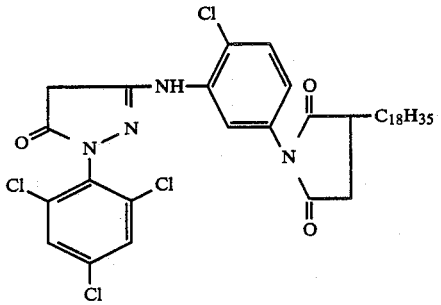

(C-1)

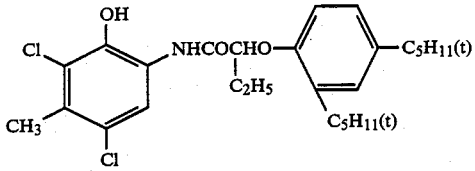

(C-2)

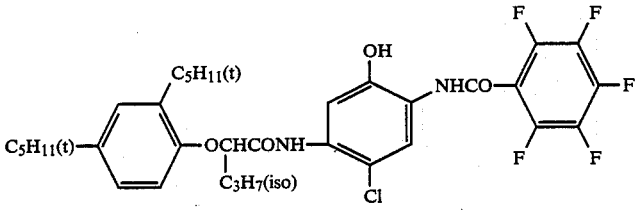

-continued (UV-1)

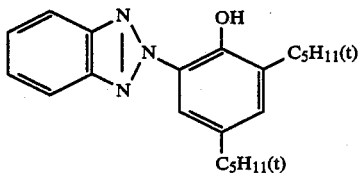

TABLE 1

| Sample No. | Blue-sensitive emulsion layer: Emulsion | Blue-sensitive emulsion layer: Elementary sulfur mg/m² | Green-sensitive emulsion layer: Emulsion | Green-sensitive emulsion layer: Elementary sulfur mg/m² | Red-sensitive emulsion layer: Emulsion | Red-sensitive emulsion layer: Elementary sulfur mg/m² | Amount of hardener 1-1 added, (g/m²) | Hardener condition[1] | Swelling degree |
|---|---|---|---|---|---|---|---|---|---|
| 1 | Em-1-4 | — | Em-2-4 | — | Em-3-4 | — | 0.08 | A | 198 |
| 2 | Em-1-4 | — | Em-2-4 | — | Em-3-4 | — | 0.08 | B | 142 |
| 3 | Em-1-4 | 0.02 | Em-2-4 | 0.02 | Em-3-4 | 0.02 | 0.08 | A | 197 |
| *4 | Em-1-4 | 0.02 | Em-2-4 | 0.02 | Em-3-4 | 0.02 | 0.08 | B | 142 |
| 5 | Em-1-4 | 0.09 | Em-2-4 | 0.09 | Em-3-4 | 0.09 | 0.08 | A | 199 |
| *6 | Em-1-4 | 0.09 | Em-2-4 | 0.09 | Em-3-4 | 0.09 | 0.08 | B | 143 |
| 7 | Em-1-1 | — | Em-2-1 | — | Em-3-1 | — | 0.08 | A | 198 |
| *8 | Em-1-1 | — | Em-2-1 | — | Em-3-1 | — | 0.08 | B | 141 |
| 9 | Em-1-2 | — | Em-2-1 | — | Em-3-1 | — | 0.08 | A | 197 |
| *10 | Em-1-2 | — | Em-2-1 | — | Em-3-1 | — | 0.08 | B | 139 |
| *11 | Em-1-3 | — | Em-2-1 | — | Em-3-1 | — | 0.08 | B | 141 |
| 12 | Em-1-2 | — | Em-2-2 | — | Em-3-2 | — | 0.08 | A | 198 |
| *13 | Em-1-2 | — | Em-2-2 | — | Em-3-2 | — | 0.08 | B | 144 |
| 14 | Em-1-3 | — | Em-2-3 | — | Em-3-3 | — | 0.08 | A | 196 |
| *15 | Em-1-3 | — | Em-2-3 | — | Em-3-3 | — | 0.08 | B | 142 |
| 16 | Em-1-2 | 0.04 | Em-2-1 | — | Em-3-3 | — | 0.08 | A | 195 |
| *17 | Em-1-2 | 0.04 | Em-2-1 | — | Em-3-3 | — | 0.08 | B | 141 |
| 18 | Em-1-2 | — | Em-2-1 | 0.04 | Em-3-3 | — | 0.08 | A | 196 |
| *19 | Em-1-2 | — | Em-2-1 | 0.04 | Em-3-3 | — | 0.08 | B | 139 |
| 20 | Em-1-2 | — | Em-2-1 | — | Em-3-3 | 0.03 | 0.08 | A | 197 |
| *21 | Em-1-2 | — | Em-2-1 | — | Em-3-3 | 0.03 | 0.08 | B | 145 |
| 22 | Em-1-2 | 0.04 | Em-2-1 | 0.04 | Em-3-3 | 0.03 | 0.08 | A | 194 |
| *23 | Em-1-2 | 0.04 | Em-2-1 | 0.04 | Em-3-3 | 0.03 | 0.08 | B | 143 |

| Sample No. | Blue-sensitive emulsion layer: S[2] | γ | Pressure in dryness, (g) | Pressure in wetness, (g) | Green-sensitive emulsion layer: S[3] | γ | Pressure in dryness, (g) | Pressure in wetness, (g) | Red-sensitive emulsion layer: S[4] | γ | Pressure in dryness, (g) | Pressure in wetness, (g) |
|---|---|---|---|---|---|---|---|---|---|---|---|---|
| 1 | 100 | 3.14 | 24 | 12 | 100 | 3.31 | 35 | 22 | 100 | 3.68 | 33 | 23 |
| 2 | 21 | 2.50 | 24 | 15 | 32 | 2.51 | 36 | 24 | 29 | 2.94 | 34 | 25 |
| 3 | 120 | 3.31 | 21 | 17 | 134 | 3.51 | 30 | 26 | 131 | 3.78 | 31 | 27 |
| *4 | 110 | 3.18 | 42 | 41 | 121 | 3.39 | 40 | 51 | 119 | 3.56 | 43 | 52 |
| 5 | 125 | 3.28 | 20 | 15 | 134 | 3.46 | 28 | 24 | 134 | 3.58 | 29 | 23 |
| *6 | 113 | 3.19 | 41 | 42 | 125 | 3.38 | 43 | 53 | 120 | 3.44 | 44 | 50 |
| 7 | 143 | 3.33 | 21 | 12 | 162 | 3.44 | 27 | 19 | 158 | 3.62 | 28 | 18 |
| *8 | 135 | 3.24 | 42 | 44 | 154 | 3.31 | 44 | 52 | 147 | 3.57 | 48 | 55 |
| 9 | 156 | 3.18 | 21 | 13 | 161 | 3.45 | 25 | 16 | 159 | 3.59 | 27 | 17 |
| *10 | 145 | 3.07 | 44 | 48 | 152 | 3.33 | 47 | 55 | 154 | 3.44 | 46 | 56 |
| *11 | 143 | 3.09 | 43 | 47 | 150 | 3.34 | 46 | 54 | 154 | 3.42 | 48 | 57 |
| 12 | 156 | 3.23 | 20 | 12 | 173 | 3.39 | 21 | 17 | 168 | 3.58 | 18 | 17 |
| *13 | 148 | 3.15 | 45 | 48 | 168 | 3.24 | 50 | 57 | 149 | 3.40 | 48 | 46 |
| 14 | 151 | 3.08 | 21 | 13 | 182 | 3.41 | 20 | 21 | 174 | 3.60 | 19 | 17 |
| *15 | 144 | 2.99 | 42 | 50 | 169 | 3.29 | 50 | 58 | 158 | 3.48 | 49 | 59 |
| 16 | 155 | 3.15 | 20 | 12 | 159 | 3.44 | 23 | 15 | 160 | 3.53 | 23 | 18 |
| *17 | 142 | 3.04 | 43 | 49 | 149 | 3.36 | 44 | 54 | 152 | 3.39 | 47 | 57 |
| 18 | 154 | 3.16 | 19 | 13 | 158 | 3.43 | 21 | 13 | 159 | 3.58 | 22 | 16 |
| *19 | 141 | 3.04 | 47 | 54 | 149 | 3.34 | 42 | 54 | 149 | 3.48 | 46 | 58 |
| 20 | 153 | 3.12 | 17 | 12 | 157 | 3.47 | 20 | 12 | 153 | 3.54 | 19 | 11 |
| *21 | 140 | 3.00 | 43 | 50 | 146 | 3.36 | 44 | 51 | 139 | 3.39 | 48 | 57 |
| 22 | 152 | 3.15 | 16 | 13 | 154 | 3.37 | 20 | 12 | 150 | 3.48 | 19 | 12 |
| *23 | 139 | 3.03 | 44 | 49 | 138 | 3.03 | 45 | 50 | 141 | 3.31 | 49 | 56 |

*indicates the invention

[1]Hardening condition, A = for 48 hours, B = 96 hours

[2,3,4]Each sensitivity of Sample No. 1 was regarded as a value of 100 relative to the corresponding sensitivities of other samples.

It is obvious from Table-1 that a high sensitivity and a high contrast were proved much better by the samples of the invention added by elementary sulfur in the light-sensitive layers thereof at least after completing a chemical ripening, as compared to the samples which did not contain any elementary sulfur, and that excellent pressure resistance each in dryness and wetness were also proved by the samples of which swelling degrees were so controlled as not to exceed

EXAMPLE-2

The samples of this example were prepared in the same manner as in Example-1, except that the Em-1-2-, Em-2-2 and Em-3-2 each prepared in Example-1 were used in the respective light-sensitive layers.

As shown in Table-2, the hardeners were added into Layer 7, respectively. The following P-1, P-2 and P-3, which are the well-known compounds effective on the improvements of pressure resistance, were also added thereto.

Further, Comparative Samples Nos. 51 and 52 were prepared in the same manner, except that the foregoing Em-1-4, Em-2-4 and Em-3-4 where used, respectively.

Each of the resulted samples where allowed to stand for 96 hours under the conditions of 38° C. and 40% RH and where then evaluated similar to Example-1. The results thereof are shown in Table-2.

Comparative compounds

P-1 Liquid paraffin

P-2 Dioctyl phthalate

P-3 $HOCH_2CH_2OH$

TABLE 2

| Sample No. | Hardener/Pressure improver Kind | Amount added, (g/m²) | Swelling degree | Blue-sensitive emulsion layer S[5] | γ | Pressure in dryness (g) | Pressure in wetness (g) | Green-sensitive emulsion layer S[6] | γ | Pressure in dryness (g) | Pressure in wetness (g) | Red-sensitive emulsion layer S[7] | γ | Pressure in dryness (g) | Pressure in wetness (g) |
|---|---|---|---|---|---|---|---|---|---|---|---|---|---|---|---|
| 31 | H-12 | 0.05 | 164 | 100 | 3.16 | 20 | 13 | 100 | 3.42 | 28 | 19 | 100 | 3.67 | 27 | 19 |
| *32 | " | 0.09 | 142 | 97 | 3.08 | 44 | 43 | 98 | 3.34 | 47 | 44 | 98 | 3.51 | 50 | 50 |
| *33 | " | 0.12 | 127 | 94 | 3.05 | 52 | 48 | 95 | 3.29 | 56 | 49 | 96 | 3.48 | 56 | 53 |
| 34 | H-19 | 0.02 | 223 | 110 | 3.18 | 19 | 10 | 121 | 3.57 | 22 | 13 | 116 | 3.67 | 24 | 14 |
| 35 | " | 0.05 | 157 | 102 | 3.19 | 18 | 11 | 104 | 3.54 | 23 | 14 | 103 | 3.66 | 23 | 12 |
| *36 | " | 0.08 | 143 | 99 | 3.10 | 43 | 49 | 99 | 3.51 | 47 | 50 | 101 | 3.51 | 48 | 50 |
| *37 | " | 0.10 | 128 | 96 | 3.08 | 50 | 53 | 95 | 3.52 | 54 | 57 | 99 | 3.44 | 55 | 53 |
| *38 | " | 0.15 | 73 | 62 | 2.94 | 51 | 54 | 68 | 3.29 | 54 | 58 | 65 | 3.30 | 57 | 54 |
| 39 | I-1 | 0.03 | 196 | 117 | 3.21 | 13 | 17 | 108 | 3.41 | 17 | 19 | 114 | 3.72 | 18 | 20 |
| 40 | " | 0.04 | 155 | 101 | 3.23 | 14 | 17 | 103 | 3.40 | 20 | 21 | 103 | 3.68 | 20 | 21 |
| *41 | " | 0.08 | 141 | 100 | 3.08 | 43 | 48 | 102 | 3.28 | 44 | 50 | 100 | 3.48 | 46 | 52 |
| *42 | " | 0.10 | 126 | 98 | 3.03 | 49 | 53 | 100 | 3.24 | 50 | 54 | 97 | 3.46 | 49 | 53 |
| *43 | " | 0.12 | 102 | 97 | 3.00 | 52 | 54 | 95 | 3.20 | 54 | 56 | 96 | 3.41 | 54 | 57 |
| *44 | " | 0.14 | 74 | 70 | 2.84 | 52 | 56 | 65 | 3.00 | 55 | 57 | 64 | 3.23 | 56 | 57 |
| 45 | H-2 | 0.14 | 160 | 100 | 3.16 | 13 | 16 | 98 | 3.44 | 18 | 21 | 99 | 3.57 | 19 | 20 |
| *46 | " | 0.17 | 139 | 94 | 3.05 | 42 | 50 | 86 | 3.32 | 47 | 52 | 89 | 3.41 | 48 | 50 |
| 47 | P-1 | 0.04 | 210 | 102 | 3.15 | 21 | 21 | 100 | 3.44 | 27 | 22 | 101 | 3.54 | 28 | 21 |
| 48 | " | 0.07 | 204 | 98 | 3.14 | 22 | 22 | 96 | 3.47 | 31 | 24 | 97 | 3.57 | 30 | 22 |
| 49 | P-2 | 0.07 | 194 | 103 | 3.17 | 24 | 30 | 102 | 3.40 | 32 | 31 | 103 | 3.68 | 32 | 29 |
| 50 | P-3 | 0.07 | 196 | 101 | 3.20 | 25 | 28 | 101 | 3.39 | 28 | 27 | 100 | 3.60 | 29 | 25 |
| 51 | H-12 | 0.05 | 167 | 82 | 3.12 | 13 | 16 | 84 | 3.35 | 19 | 17 | 80 | 3.48 | 20 | 18 |
| 52 | " | 0.09 | 143 | 63 | 2.48 | 14 | 18 | 71 | 2.60 | 21 | 18 | 68 | 3.00 | 21 | 20 |

*indicates the invention

[5,6,7]Each sensitivity of Sample No. 31 was regarded as a value of 100 relative to the sensitivities of other samples.

As is obvious from the above Table-2. it is found that every and all the samples relating to the invention have displayed a high sensitivity and high contrast owing to the elementary sulfur added thereto, and that pressure resistance in both dryness and wetness can be improved by controlling the swelling degree so as not to exceed 150. It is further found that, when a swelling degree is lowered so as not to exceed 80, a sensitivity will be somewhat lowered to soften a contrast, so that a developing rate will be somewhat lowered.

EXAMPLE-3

In this example. Em-1-5 was prepared in the following manner. To the Em-1 which had been prepared in Example-1 was added with sodium thiosulfate as a sulfur-sensitizer in an amount of $7\times10^{-6}$ mol per mol of silver halide. aurochloric acid as a gold-sensitizer in an amount of $3\times^{-6}$ mol per mol of silver halide, a blue-sensitive sensitizing dye IV-3 in an amount of $3\times10^{31\ 4}$ mol per mol of silver halide, a stabilizer IIIb-5 in an amount of $5\times10^{-5}$ mol per mol of silver halide, and elementary sulfur in an amount of $2\times10^{-2}$ mg per mol of silver halide, then, a chemical ripening thereof was carried out and, at the point of time when the chemical ripening was completed, a stabilizer IIIb-5 was further added in an amount of $5\times10^{-4}$ mol per mol of silver halide.

On the other hand, an emulsion Em-1-6 was prepared in the same manner as above, except that a chemical ripening was carried out without using elementary sulfur. Em-2-5 was prepared in the following manner. To the Em-2 which had been prepared in Example-1 was added with sodium thiosulfate as a sulfur-sensitizer in an amount of $1\times10^{-5}$ mol per mol of silver halide, aurochloric acid as a gold-sensitizer in an amount of $6\times10^{-6}$ mol per mol of silver halide, a green-sensitive sensitizing dye GSD-1 in an amount of $2\times10^{-4}$ mol per mol of silver halide, a stabilizer IIIb-5 in an amount of $1\times10^{-4}$ mol per mol of silver halide, and elementary sulfur in an amount of $1\times10^{-5}$ mg per mol of silver halide, then, a chemical ripening thereof was carried out and, at the point of time when the chemical ripening was completed, a stabilizer IIIb-5 was further added in an amount of $5\times10^{-4}$ mol per mol of silver halide.

On the other hand, an emulsion Em-2-6 was prepared in the same manner as above, except that a chemical ripening was carried out without using elementary sulfur.

Em-3-5 was prepared in the following manner. To the Em-3 which had been prepared in Example-1 was added with sodium thiosulfate as a sulfur-sensitizer in an amount of $2\times10^{-5}$ mol per mol of silver halide, aurochloric acid as a gold-sensitizer in an amount of $1\times10^{-5}$ mol per mol of silver halide, a red-sensitive sensitizing dye RSD-I in an amount of $2\times10^{-4}$ mol per mol of silver halide, a stabilizer IIIb-5 in an amount of $2\times10^{-4}$ mol per mol of silver halide, and elementary sulfur in an amount of 0.1 mg per mol of silver halide, then, a chemical ripening thereof was carried out and, at the point of time when the chemical ripening was completed, a stabilizer IIIb-5 was further added in an amount of $4\times10^{-4}$ mol per mol of silver halide.

On the other hand, an emulsion Em-3-6 was prepared in the same manner as above, except that a chemical ripening was carried out without using elementary sulfur.

The resulted emulsions were coated in the same manner as in Example-1 and then dried, respectively. Further, such a stabilizer as shown in Table-3 was added to each of Layers 1. 3 and 5. The hardeners H-19 and I-1 were selectively added to Layers 2. 4. 6 and 7 as shown in Table-3. The resulted samples were allowed to stand under the conditions given in Table-3 and were then evaluated in the same manner as in Example-1, respectively.

The results thereof are shown in Table-4.

As is obvious from Table-4, it is found that the samples relating to the invention each have the characteristics such as a high sensitivity and a high contrast and they are also excellent in pressure resistance.

When they were hardened under the other conditions than those of a temperature of from 30° to 3° C. a humidity of from 30 to 80% RH and an allowing time to stand from 15 to 180 hours, both of the contrast gradation and the pressure resistance in dryness thereof were somewhat lowered.

It is also found that the effects of the invention may not be damaged even if various hardeners are added to plenty of layers.

When adding the stabilizer represented by Formula III to Layers 1, 3 and 5, the samples of the invention can be particularly effective on making contrast harder and pressure resistance higher, as compared to the samples without containing any additive or to the Comparative Samples ST-1 and ST-2.

TABLE 3

| Sample No. | Layer 1 Emulsion | Layer 1 Stabilizer Kind | Layer 1 Stabilizer Amount added, (g/m²) | Layer 3 Emulsion | Layer 3 Stabilizer Kind | Layer 3 Stabilizer Amount added, (g/m²) | Layer 5 Emulsion | Layer 5 Stabilizer Kind | Layer 5 Stabilizer Amount added, (g/m²) | Hardener in layer 2 Kind | Hardener in layer 2 Amount added, (g/m²) |
|---|---|---|---|---|---|---|---|---|---|---|---|
| 61 | Em-1-6 | — | — | Em-2-6 | — | — | Em-3-6 | — | — | — | — |
| 62 | " | — | — | " | — | — | " | — | — | — | — |
| 63 | Em-1-5 | — | — | Em-2-5 | — | — | Em-3-5 | — | — | — | — |
| 64 | " | — | — | " | — | — | " | — | — | — | — |
| 65 | " | — | — | " | — | — | " | — | — | — | — |
| 66 | " | — | — | " | — | — | " | — | — | — | — |
| 67 | " | — | — | " | — | — | " | — | — | — | — |
| 68 | " | — | — | " | — | — | " | — | — | — | — |
| 69 | " | — | — | " | — | — | " | — | — | — | — |
| 70 | " | — | — | " | — | — | " | — | — | — | — |
| 71 | " | — | — | " | — | — | " | — | — | — | — |
| 72 | " | — | — | " | — | — | " | — | — | — | — |
| 73 | " | — | — | " | — | — | " | — | — | — | — |
| 74 | " | — | — | " | — | — | " | — | — | — | — |
| 75 | " | — | — | " | — | — | " | — | — | — | — |
| 76 | " | — | — | " | — | — | " | — | — | — | — |
| 77 | " | — | — | " | — | — | " | — | — | — | — |
| 78 | " | — | — | " | — | — | " | — | — | — | — |
| 79 | " | — | — | " | — | — | " | — | — | — | — |
| 80 | " | — | — | " | — | — | " | — | — | — | — |
| 81 | " | — | — | " | — | — | " | — | — | — | — |
| 82 | " | — | — | " | — | — | " | — | — | — | — |
| 83 | " | — | — | " | — | — | " | — | — | H-19 | 0.02 |
| 84 | " | — | — | " | — | — | " | — | — | " | 0.03 |
| 85 | " | — | — | " | — | — | " | — | — | " | " |
| 86 | " | — | — | " | — | — | " | — | — | " | 0.02 |
| 87 | " | IIIa-1 | $4 \times 10^{-3}$ | " | IIIa-1 | $2 \times 10^{-3}$ | " | IIa-1 | $2 \times 10^{-3}$ | " | 0.03 |
| 88 | " | " | " | " | " | " | " | " | " | " | " |
| 89 | " | IIIb-7 | " | " | IIIb-7 | " | " | IIIb-7 | " | " | " |
| 90 | " | " | " | " | " | " | " | " | " | " | " |
| 91 | " | IIIb-5 | " | " | IIIb-5 | " | " | IIIb-5 | " | " | " |
| 92 | " | " | " | " | " | " | " | " | " | " | " |
| 93 | " | ST-1 | " | " | ST-1 | " | " | ST-1 | " | " | " |
| 94 | " | " | " | " | " | " | " | " | " | " | " |
| 95 | " | ST-2 | " | " | ST-2 | " | " | ST-2 | " | " | " |
| 96 | " | " | " | " | " | " | " | " | " | " | " |

| Sample No. | Hardener in layer 4 Kind | Hardener in layer 4 Amount added, (g/m²) | Hardener in layer 6 Kind | Hardener in layer 6 Amount added, (g/m²) | Hardener in layer 7 Kind | Hardener in layer 7 Amount added, (g/m²) | Hardening conditions Temperature, (°C.) | Hardening conditions Humidity, (%) | Hardening conditions Standing time, (hour) |
|---|---|---|---|---|---|---|---|---|---|
| 61 | — | — | H-19 | 0.03 | I-1 | 0.05 | 40 | 40 | 100 |
| 62 | — | — | " | " | " | " | " | " | 120 |
| 63 | — | — | " | " | " | " | " | " | 50 |
| 64 | — | — | " | " | " | " | " | " | 100 |
| 65 | — | — | " | " | " | " | " | " | 120 |
| 66 | — | — | " | " | " | " | " | " | 185 |
| 67 | — | — | " | " | " | " | 26 | " | 100 |
| 68 | — | — | " | " | " | " | " | " | 150 |
| 69 | — | — | " | " | " | " | 33 | " | 120 |
| 70 | — | — | " | " | " | " | 53 | " | 10 |
| 71 | — | — | " | " | " | " | " | " | 25 |
| 72 | — | — | " | " | " | " | 50 | " | 8 |
| 73 | — | — | " | " | " | " | " | " | 13 |

TABLE 3-continued

| | | | | | | | | | |
|---|---|---|---|---|---|---|---|---|---|
| 74 | — | — | " | " | " | " | 40 | 23 | 60 |
| 75 | — | — | " | " | " | " | " | " | 90 |
| 76 | — | — | " | " | " | " | " | " | 130 |
| 77 | — | — | " | " | " | " | " | 70 | 90 |
| 78 | — | — | " | " | " | " | " | 84 | 60 |
| 79 | — | — | " | " | " | " | " | " | 90 |
| 80 | — | — | " | " | " | " | " | " | 130 |
| 81 | I-1 | 0.03 | — | — | " | 0.06 | " | 40 | 90 |
| 82 | " | 0.04 | — | — | " | 0.04 | " | " | " |
| 83 | — | — | — | — | " | 0.07 | " | " | " |
| 84 | — | — | — | — | " | " | " | " | " |
| 85 | I-1 | 0.02 | — | — | " | 0.05 | " | " | " |
| 86 | " | " | — | — | " | 0.04 | " | " | " |
| 87 | " | " | — | — | " | 0.05 | " | " | " |
| 88 | " | " | — | — | " | " | " | " | " |
| 89 | " | " | — | — | " | " | " | " | " |
| 90 | " | " | — | — | " | " | " | " | " |
| 91 | " | " | — | — | " | " | " | " | " |
| 92 | " | " | — | — | " | " | " | " | " |
| 93 | " | " | — | — | " | " | " | " | " |
| 94 | " | " | — | — | " | " | " | " | " |
| 95 | " | " | — | — | " | " | " | " | " |
| 96 | " | " | — | — | " | " | " | " | " |

TABLE 4

| | | Blue-sensitive emulsion layer | | | | Green-sensitive emulsion layer | | | | Red-sensitive emulsion layer | | | |
|---|---|---|---|---|---|---|---|---|---|---|---|---|---|
| Sample No. | Swelling degree | $S^8$ | γ | Pressure in in dryness, (g) | Pressure in in wetness, (g) | $S^9$ | γ | Pressure in in dryness, (g) | Pressure in in wetness, (g) | $S^{10}$ | γ | Pressure in in dryness, (g) | Pressure in in wetness, (g) |
| 61 | 138 | 100 | 2.76 | 18 | 12 | 100 | 2.99 | 19 | 14 | 100 | 2.64 | 19 | 15 |
| 62 | 119 | 86 | 2.01 | 21 | 12 | 91 | 2.45 | 22 | 15 | 87 | 2.22 | 22 | 16 |
| 63 | 194 | 223 | 3.21 | 19 | 13 | 243 | 3.51 | 20 | 14 | 215 | 3.78 | 21 | 15 |
| *64 | 142 | 214 | 3.78 | 52 | 48 | 238 | 3.52 | 52 | 50 | 210 | 3.76 | 53 | 49 |
| *65 | 120 | 210 | 3.15 | 53 | 49 | 232 | 3.49 | 53 | 52 | 209 | 3.77 | 52 | 53 |
| *66 | 108 | 208 | 2.90 | 53 | 39 | 230 | 3.20 | 53 | 39 | 206 | 3.39 | 53 | 40 |
| *67 | 143 | 206 | 2.92 | 52 | 38 | 225 | 3.18 | 52 | 38 | 200 | 3.36 | 53 | 39 |
| *68 | 139 | 203 | 2.94 | 51 | 39 | 226 | 3.21 | 52 | 38 | 199 | 3.34 | 52 | 39 |
| *69 | 118 | 209 | 3.17 | 53 | 48 | 237 | 3.56 | 52 | 50 | 209 | 3.76 | 52 | 49 |
| *70 | 147 | 205 | 2.96 | 52 | 38 | 229 | 3.16 | 54 | 39 | 202 | 3.38 | 54 | 39 |
| *71 | 121 | 203 | 3.22 | 50 | 43 | 224 | 3.47 | 54 | 45 | 199 | 3.69 | 55 | 48 |
| *72 | 142 | 206 | 2.94 | 52 | 36 | 225 | 3.13 | 53 | 39 | 200 | 3.36 | 53 | 38 |
| *73 | 129 | 204 | 2.90 | 50 | 35 | 221 | 3.10 | 50 | 36 | 195 | 3.33 | 51 | 37 |
| 74 | 187 | 219 | 3.18 | 18 | 12 | 237 | 3.46 | 19 | 13 | 212 | 3.69 | 20 | 13 |
| *75 | 142 | 211 | 2.94 | 49 | 36 | 228 | 3.11 | 51 | 38 | 206 | 3.38 | 52 | 37 |
| *76 | 121 | 206 | 2.91 | 51 | 34 | 221 | 3.10 | 52 | 35 | 200 | 3.32 | 52 | 35 |
| *77 | 139 | 209 | 3.23 | 50 | 43 | 227 | 3.49 | 52 | 44 | 208 | 3.71 | 53 | 45 |
| *78 | 178 | 220 | 3.19 | 21 | 14 | 239 | 3.50 | 23 | 15 | 214 | 3.68 | 22 | 15 |
| *79 | 138 | 215 | 2.89 | 46 | 34 | 226 | 3.09 | 47 | 35 | 209 | 3.36 | 47 | 36 |
| *80 | 123 | 208 | 2.88 | 45 | 33 | 215 | 3.10 | 46 | 34 | 203 | 3.34 | 46 | 34 |
| *81 | 134 | 219 | 3.21 | 51 | 44 | 226 | 3.48 | 53 | 48 | 218 | 3.69 | 53 | 48 |
| *82 | 119 | 213 | 3.24 | 52 | 43 | 219 | 3.52 | 54 | 44 | 213 | 3.74 | 54 | 44 |
| *83 | 121 | 217 | 3.18 | 53 | 42 | 217 | 3.46 | 55 | 45 | 212 | 3.78 | 53 | 46 |
| *84 | 113 | 214 | 3.23 | 50 | 45 | 220 | 3.57 | 52 | 47 | 217 | 3.69 | 52 | 47 |
| *85 | 128 | 221 | 3.22 | 49 | 45 | 216 | 3.53 | 52 | 46 | 216 | 3.74 | 53 | 46 |
| 86 | 168 | 227 | 2.81 | 20 | 11 | 238 | 3.08 | 20 | 12 | 221 | 3.29 | 21 | 12 |
| *87 | 128 | 203 | 3.31 | 61 | 49 | 221 | 3.48 | 63 | 51 | 215 | 3.68 | 63 | 51 |
| *88 | 127 | 202 | 3.33 | 63 | 50 | 219 | 3.45 | 64 | 52 | 214 | 3.74 | 64 | 52 |
| *89 | 129 | 206 | 3.24 | 64 | 53 | 217 | 3.49 | 65 | 54 | 218 | 3.71 | 65 | 54 |
| *90 | 126 | 204 | 3.20 | 62 | 55 | 213 | 3.49 | 63 | 56 | 217 | 3.65 | 64 | 56 |
| *91 | 127 | 208 | 3.34 | 61 | 54 | 220 | 3.51 | 63 | 56 | 220 | 3.77 | 64 | 56 |
| *92 | 127 | 207 | 3.29 | 61 | 55 | 219 | 3.53 | 63 | 57 | 220 | 3.75 | 63 | 57 |
| *93 | 128 | 213 | 3.08 | 48 | 37 | 223 | 3.20 | 49 | 38 | 220 | 3.34 | 49 | 38 |
| *94 | 127 | 215 | 3.09 | 49 | 38 | 224 | 3.18 | 49 | 39 | 223 | 3.36 | 50 | 39 |
| *95 | 126 | 216 | 3.11 | 51 | 33 | 224 | 3.19 | 50 | 35 | 219 | 3.29 | 48 | 36 |
| *96 | 126 | 215 | 3.06 | 50 | 34 | 221 | 3.16 | 51 | 35 | 218 | 3.31 | 50 | 35 |

*indicates the invention

[8,9,10]Each sensitivity of Sample No. 61 was regarded as a value of 100 relative to the sensitivities of other samples.

EXAMPLE-4

Emulsion Em-4 was prepared in the same manner as Em-1 of Example-1, except that dipotassium hexachloroiridate Ir-1 was added in an amount of 0.14 mg per mol of silver halide in a position of adding 20% of a total amount of silver added and, immediately after the total amount of silver was completely added, a stabilizer IIIb-5 was added in an amount of $4\times10^{-5}$ mol per mol of silver halide.

The resulted Em-4 was added with aurochloric acid as a gold-sensitizer in an amount of $3\times10^{-6}$ mol per mol of silver halide, a blue-sensitive sensitizing dye of the kinds and in the amounts each shown in Table-5, a stabilizer IIIb-5 in an amount of $5\times10^{-5}$ mol per mol of silver halide, elementary sulfur in the amount shown in Table-5 and, at the point of time when a chemical ripening was completed, another stabilizer IIIb-7 was further added in an amount of $4\times10^{-4}$ mol per mol of silver halide.

TABLE 5

| Sample No. | Blue-sensitive emulsion: Blue-sensitive sensitizing dye Kind | Blue-sensitive emulsion: Blue-sensitive sensitizing dye Amount added. mol/mol of AgX | Blue-sensitive emulsion: Inorganic-sulfur mg/mol of AgX | Green-sensitive emulsion: Elementary sulfur mg/mol of AgX | Red-sensitive emulsion: Elementary sulfur mg/mol of AgX | Blue-sensitive emulsion layer: $S^{11}$ | Blue-sensitive emulsion layer: γ | Blue-sensitive emulsion layer: Pressure in dryness, (g) | Blue-sensitive emulsion layer: Pressure in wetness, (g) | Green-sensitive emulsion layer: $S^{12}$ | Green-sensitive emulsion layer: γ | Green-sensitive emulsion layer: Pressure in dryness, (g) | Green-sensitive emulsion layer: Pressure in wetness, (g) | Red-sensitive emulsion layer: $S^{13}$ | Red-sensitive emulsion layer: γ | Red-sensitive emulsion layer: Pressure in dryness, (g) | Red-sensitive emulsion layer: Pressure in wetness, (g) |
|---|---|---|---|---|---|---|---|---|---|---|---|---|---|---|---|---|---|
| 101 | IV-3 | $3\times10^{-4}$ | — | — | — | 100 | 2.51 | 24 | 21 | 100 | 2.87 | 28 | 24 | 100 | 3.01 | 29 | 24 |
| 102 | " | " | 0.01 | 0.01 | 0.01 | 154 | 3.27 | 52 | 52 | 178 | 3.56 | 53 | 54 | 187 | 3.86 | 54 | 54 |
| 103 | " | " | 0.1 | 0.01 | 0.01 | 153 | 3.42 | 61 | 58 | 178 | 3.52 | 53 | 55 | 188 | 3.84 | 53 | 53 |
| 104 | " | " | 0.5 | 0.01 | 0.01 | 141 | 3.33 | 57 | 56 | 176 | 3.54 | 52 | 54 | 186 | 3.78 | 52 | 50 |
| 105 | " | " | 0.1 | 0.01 | 0.01 | 136 | 3.24 | 53 | 54 | 176 | 3.50 | 53 | 54 | 187 | 3.83 | 53 | 51 |
| 106 | " | " | 0.1 | 0.1 | 0.1 | 154 | 3.47 | 60 | 57 | 169 | 3.64 | 59 | 59 | 175 | 3.99 | 63 | 60 |
| 107 | " | " | 0.1 | 0.2 | 0.1 | 155 | 3.44 | 60 | 56 | 154 | 3.58 | 56 | 57 | 176 | 4.00 | 62 | 58 |
| 108 | " | " | 0.1 | 0.2 | 0.2 | 154 | 3.46 | 59 | 56 | 153 | 3.57 | 56 | 57 | 163 | 3.80 | 59 | 57 |
| 109 | " | $1\times10^{-4}$ | 0.1 | 0.1 | 0.1 | 137 | 3.35 | 57 | 53 | 170 | 3.63 | 57 | 57 | 174 | 3.94 | 62 | 58 |
| 110 | " | $5\times10^{-4}$ | " | " | " | 164 | 3.32 | 56 | 54 | 171 | 3.64 | 58 | 57 | 173 | 3.92 | 61 | 59 |
| 111 | IV-2 | $3\times10^{-4}$ | " | " | " | 148 | 3.36 | 58 | 56 | 170 | 3.60 | 58 | 56 | 172 | 3.90 | 61 | 58 |
| 112 | " | $5\times10^{-4}$ | " | " | " | 152 | 3.25 | 57 | 54 | 171 | 3.59 | 58 | 57 | 173 | 3.86 | 60 | 59 |
| 113 | OV-4 | $3\times10^{-4}$ | " | " | " | 139 | 3.38 | 59 | 56 | 169 | 3.62 | 57 | 57 | 172 | 3.85 | 60 | 58 |
| 114 | " | $5\times10^{-4}$ | " | " | " | 141 | 3.31 | 57 | 54 | 169 | 3.58 | 57 | 58 | 171 | 3.87 | 59 | 58 |
| 115 | IV-6 | $3\times10^{-4}$ | " | " | " | 155 | 3.29 | 56 | 53 | 171 | 3.64 | 58 | 57 | 170 | 3.91 | 59 | 58 |
| 116 | " | $5\times10^{-4}$ | " | " | " | 162 | 3.31 | 55 | 52 | 170 | 3.60 | 57 | 56 | 170 | 3.86 | 59 | 58 |
| 117 | IV-16 | $3\times10^{-4}$ | " | " | " | 132 | 3.25 | 53 | 51 | 170 | 3.58 | 56 | 56 | 172 | 3.89 | 58 | 58 |
| 118 | " | $5\times10^{-4}$ | " | " | " | 134 | 3.21 | 52 | 50 | 171 | 5.57 | 57 | 56 | 171 | 3.85 | 59 | 58 |
| 119 | BSD-1 | $3\times10^{-4}$ | " | " | " | 115 | 3.00 | 42 | 38 | 169 | 3.52 | 58 | 57 | 171 | 3.79 | 59 | 57 |
| 120 | " | $5\times10^{-4}$ | " | " | " | 113 | 2.94 | 41 | 37 | 168 | 3.51 | 57 | 57 | 170 | 3.75 | 59 | 58 |
| 121 | BSD-2 | $3\times10^{-4}$ | " | " | " | 121 | 3.88 | 41 | 36 | 170 | 3.54 | 59 | 58 | 170 | 3.82 | 60 | 57 |
| 122 | " | $5\times10^{-4}$ | " | " | " | 119 | 2.82 | 41 | 35 | 169 | 3.56 | 58 | 57 | 169 | 3.80 | 59 | 59 |
| 123 | IV-3 | $3\times10^{-4}$ | — | — | — | 102 | 2.38 | 17 | 10 | 103 | 2.69 | 18 | 11 | 104 | 2.81 | 18 | 11 |

*Sample Nos. 1, 2 and 3 are for Comparative, and the other samples are of the invention.

[11,12,13]Each sensitivity of Sample No. 101 was regarded as a value of 100 relative to the sensitivities of other samples.

added in an amount of $5\times10^{-4}$ mol per mol of silver halide.

Emulsion Em-5 was prepared in the same manner as Em-2 prepared in Example-1, except that the foregoing Ir-1 was added in an amount of 0.42 mg per mol of silver halide in a position of adding 20% of a total amount of silver added.

The resulted Em-5 was added with sodium thiosulfate as a sulfur-sensitizer in an amount of $1\times10^{-5}$ mol per mol of silver halide, aurochloric acid as a gold-sensitizer in an amount of $6\times10^{-6}$ mol per mol of silver halide, a green-sensitive sensitizing dye GSD-1 in an amount Of $2\times10^{-4}$ mol per mol of silver halide, a stabilizer IIIb-5 in an amount of $1\times10^{-4}$ mol per mol of silver halide, elementary sulfur in the amount shown in Table-5 and, at the point of time when a chemical ripening was completed, another stabilizer IIIb-7 was further added in an amount of $5\times10^{-4}$ mol per mol of silver halide.

Emulsion Em-6 was prepared in the same manner as Em-3 prepared in Example-1, except that the foregoing Ir-1 was added in an amount of 0.42 mg per mol of silver halide in a position of adding 20% of a total amount of silver added.

The resulted Em-6 was added with sodium thiosulfate as a sulfur-sensitizer in an amount of $2\times10^{-5}$ mol per mol of silver halide, aurochloric acid as a gold-sensitizer in an amount of $1\times10^{-5}$ mol per mol of silver halide, a red-sensitive sensitizing dye RSD-1 in an amount of $2\times10^{-4}$ mol per mol of silver halide, a stabilizer IIIb-5 in an amount of $2\times10^{-4}$ mol per mol of silver halide, elementary sulfur in the amount shown in Table-5 and, at the point of time when a chemical ripening was completed, the stabilizer IIIb-5 was further The resulted emulsions were coated in the same manner as in Example-1 and then dried. On the other hand. Layer 2 was added with H-19 in an amount of 0.03 g/m$^2$. Layer 4 was added with I-1 in an amount of 0.02 g/m$^2$, and Layer 7 was added with I-1 in an amount of 0.05 g/m$^2$. The resulted samples were allowed to stand for 100 hours under the conditions of 40° C. and 40%RH and were then evaluated in the same manner as in Example-1. Em-1, Em-2 and Em-3 each were chemically ripened in the same manner as in Em-4. Em-5 and Em-6, except that no elementary sulfur was added, respectively. The resulted emulsions are named Em-1-7, Em-2-7 and Em-3-7, respectively. Em-1-7, Em-2-7 and Em-3-7 were also coated in the above-mentioned manner and were then evaluated. The resulted sample is called No. 123.

As is apparent from Table-5, as in Comparative Sample No. 101, a pressure resistance cannot satisfactorily be improved, even if a water-soluble iridium compound is added into silver halide grains, and the samples relating to the invention are excellent in high contrast as well as in pressure resistance.

When using a dye BSD-1 or BSD-2 other than those represented by the foregoing Formula IV. the effects on high contrast and pressure resistance in wetness are diminished. It is therefore found, from the above-mentioned facts, that a contrast gradation and pressure resistance will be somewhat affected by the kinds of blue-sensitive sensitizing dyes.

Accordingly, it will become apparent to be able to improve the above-mentioned characteristics when using the blue-sensitive sensitizing dyes represented by Formula IV.

What is claimed is:

1. A silver halide photographic light-sensitive material comprising a support bearing theron, a photographic component layer including a silver halide emulsion layer wherein the swelling degree of said photographic component layer is not higher than 150 and said silver halide emulsion layer is added with elementary sulfur.

2. The material of claim 1, wherein said swelling degree is within the range of from 80 to 150.

3. The material of claim 2, wherein said swelling degree is within the range of from 100 to 140.

4. The material of claim 1, wherein said elementary sulfur is α-sulfur.

5. The material of claim 1, wherein said elementary sulfur is added to said silver halide emulsion layer in an amount of from $1\times10^{-5}$ mg to 10 mg per mole of silver halide contained in said silver halide emulsion layer.

6. The material of claim 5, wherein said elementary sulfur is added to said silver halide emulsion layer in an amount of from $1\times10^{-3}$ mg to 5 mg per mole of silver halide contained in said silver halide emulsion layer.

7. The material of claim 1, wherein said photographic component layer is hardened with a hardener selected from the group consisting of vinylsulfone-type hardeners, and compounds represented by the following Formulas I and Formula II;

Formula I

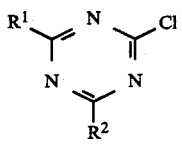

wherein $R^1$ is a chlorine atom, a hydroxyl group, an alkyl group, an alkoxy group, an alkylthio group, an —$OM_1$ group, an —$NR^5R^6$ group or an —$NHCOR^7$ group, in which $M_1$ is a mono-valent metel atom, $R^5$, $R^6$ and $R^7$ are each a hydrogen atom, an alkyl group or an aryl group; and $R^2$, is the same as the $R^1$ except the chlorine atom, Formula II

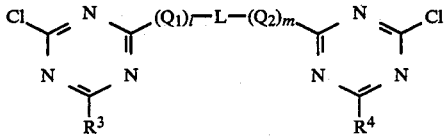

wherein $R^3$ and $R^4$ are each a chlorine atom, a hydroxy group, an alkyl group, an alkoxy group or —$OM_1$ group, in which $M^1$ is a mono-valent metal atom; $Q_1$ and $Q_2$ are each an —O—atom, a —S— atom or an —NH— group; L is an alkylene group or an arylene group; and l and m are each zero or 1.

8. The material of claim 1, wherein said photographic component layer contains a compound represented by the following Formula III;

Formula III

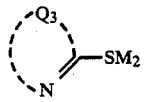

wherein $Q_3$ a groups of atoms necessary to complete a 5-member heterocycle or a 5-member heterocycle condensed with a benzene ring; $M_2$ is a hydrogen atom, an alkali metal atom or an ammonium group.

9. The material of claim 8, wherein said compound is a compound represented by the following Formulas IIIa or IIIb;

Formula IIIa

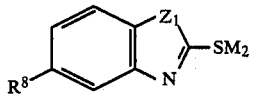

wherein $R^8$ is a hydrogen atom, an alkyl group, a halogen atom, a carboxyl group or a salt thereof, a sulfo group or a salt therof, an amino grou or an alkoxy group; and $Z_1$ is a —NH— group, an —O— atom or an —S— atom;

Formula IIIb

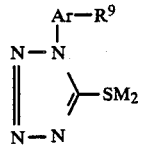

wherein Ar is a phenyl group, a naphthyl group ar a cyclohexyl group; $R^9$ is a hydrogen atom, an alkyl group, an alkoxy group, a carboxyl group or a salt thereof, a sulfo group or a salt thereof, a hydroxyl group, an amino group, an acylamino group, a carbamoyl group or a sulfoamido group.

10. The material of claim 1, wherein silver halide grains contained in said silver halide emulsion layer are substantially consisting of silver chlorobromide comprising not less than 80 mole % of silver chloride.

11. The material of claim 10, wherein said silver halide grains comprises from 98 mole % to 99.9 mole % of silver chloride.

12. The material of claim 1, wherein said silver halide emulsion layer is a blue-sensitive layer.

13. The material of claim 12, wherein said silver halide emulsion layer contains a compound represented by the following Formula IV;

Formula IV

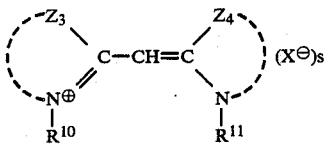

wherein $Z_3$ and $Z_4$ are each a group of atoms necessary to complete an oxazole ring, a thiazole ring, a selenazole ring, a pyridine ring, a benzoxazole ring, benzoselenazole ring, a benzimidazole ring, a naphthoxazole ring, a naphthothiazole ring, a naphthoxazole ring, a naphthoimidazole ring or a quinoline ring; $R^{10}$ and $R^{11}$ are each an alkyl group, an akenyl group or an aryl group; $X^{\ominus}$is an anion and s is zero or 1.

* * * * *